United States Patent [19]

Wachi

[11] 4,418,600

[45] Dec. 6, 1983

[54] ELECTRONIC MUSICAL INSTRUMENTS OF THE TYPE SYNTHESIZING A PLURALITY OF PARTIAL TONE SIGNALS

[75] Inventor: Masatada Wachi, Hamamatsu, Japan

[73] Assignee: Nippon Gakki Seizo Kabushiki Kaisha, Hamamatsu, Japan

[21] Appl. No.: 293,699

[22] Filed: Aug. 17, 1981

[30] Foreign Application Priority Data

Sep. 8, 1980 [JP] Japan ..... 55-124930

[51] Int. Cl.[3] ..... G10H 1/02

[52] U.S. Cl. ..... 84/1.19; 84/1.01

[58] Field of Search ..... 84/1.01, 1.19, 1.21, 84/1.22, 1.23, 1.24, DIG. 9, DIG. 10

[56] References Cited

U.S. PATENT DOCUMENTS 4,244,257 1/1981 Niimi et al. ..... 84/1.01

4,351,219 9/1982 Bass ..... 84/1.21

FOREIGN PATENT DOCUMENTS 2853209 6/1979 Fed. Rep. of Germany .

2945901 6/1980 Fed. Rep. of Germany .

53-32028 6/1978 Japan .

*Primary Examiner*—F. W. Isen

*Attorney, Agent, or Firm*—Spensley, Horn, Jubas & Lubitz

[57] ABSTRACT

A predetermined frequency signal is amplitude modulated with a time window signal having a predetermined time width to simultaneously calculate a plurality of frequency components distributed over a predetermined frequency bandwidth and having the frequency component as a center component, and the plurality of frequency components thus calculated are used as partial tone components to form a musical tone signal. The frequency signal and the time window signal are formed by using a common function signal generator, on a time division basis, which produces the frequency signal and the time window signal. This construction makes it possible to form a musical tone having a great number of harmonic components at high speeds with a simple circuit construction.

11 Claims, 12 Drawing Figures

(C)

ELECTRONIC MUSICAL INSTRUMENTS OF THE TYPE SYNTHESIZING A PLURALITY OF PARTIAL TONE SIGNALS

BAKGROUND OF THE INVENTION

This invention relates to an electronic musical instrument and more particularly an electronic musical instrument of the type for sequencially calculating a plurality of partial tone signals with a plurality of time divisioned time slots such that these partial tone signals are synthesized to form a musical tone signal.

As disclosed in Japanese Preliminary Publication of Patent No. 32028/1980, it has been proposed an electronic musical instrument in which a predetermined time window signal such as a Hanning window signal is multiplied with a predetermined frequency signal (for instance, a sine wave signal) for simultaneously calculating a plurality of partial tone components over a predetermined frequency bandwidth having a predetermined frequency signal as the center component.

According to this electronic musical instrument, however, a waveform prepared by amplitude modulating a predetermined frequency signal with a Hanning window signal is prestored in a memory device and then read out therefrom with an address signal having a period corresponding to the time width of the Hanning window signal, so that the relation between the Hanning window signal and the predetermined frequency signal would be fixed whereby it is impossible to arbitrarily set the frequency bandwidth of a plurality of partial tone components which are calculated simultaneously.

SUMMARY OF THE INVENTION

Accordingly it is an object of this invention to provide a novel electronic musical instrument which can eliminate the difficulty described above and can form a plurality of partial tone components with a simple construction.

An electronic musical instrument comprising:

phase designation generating means for generating first and second phase designation signals on a time division basis;

function generating means connected to said phase designation generating means generating a frequency signal having a frequency in response to said first signal and a window signal having a time width in response to said second signal;

modulating means for amplitude-modulating said frequency signal in accordance with said window signal and producing a modulated signal; and means for forming a musical tone corresponding to said modulated signal.

More particularly, a first time slot is used to generate a function signal (sine or cosine wave signal) at a period corresponding to the time width of a time window signal to be generated from the function signal generators and the second time slot is used to generate another function signal (sine or cosine signal) at a frequency of a frequency signal to be generated in the function signal generator. The function signal generated with the first time slot is arithmetically processed (for example the amplitude value of the function signal is squared) to form a time window signal having a predetermined time width the function signal formed with the second time slot and acting as a frequency signal is amplitude-modulated with the time window signal so as to simultaneously calculate a number of partial tone components distributed over a predetermined frequency bandwidth having the frequency signal as the center component.

DESCRIPTION OF THE PREFERRED EMBODIMENT

Figure 1:
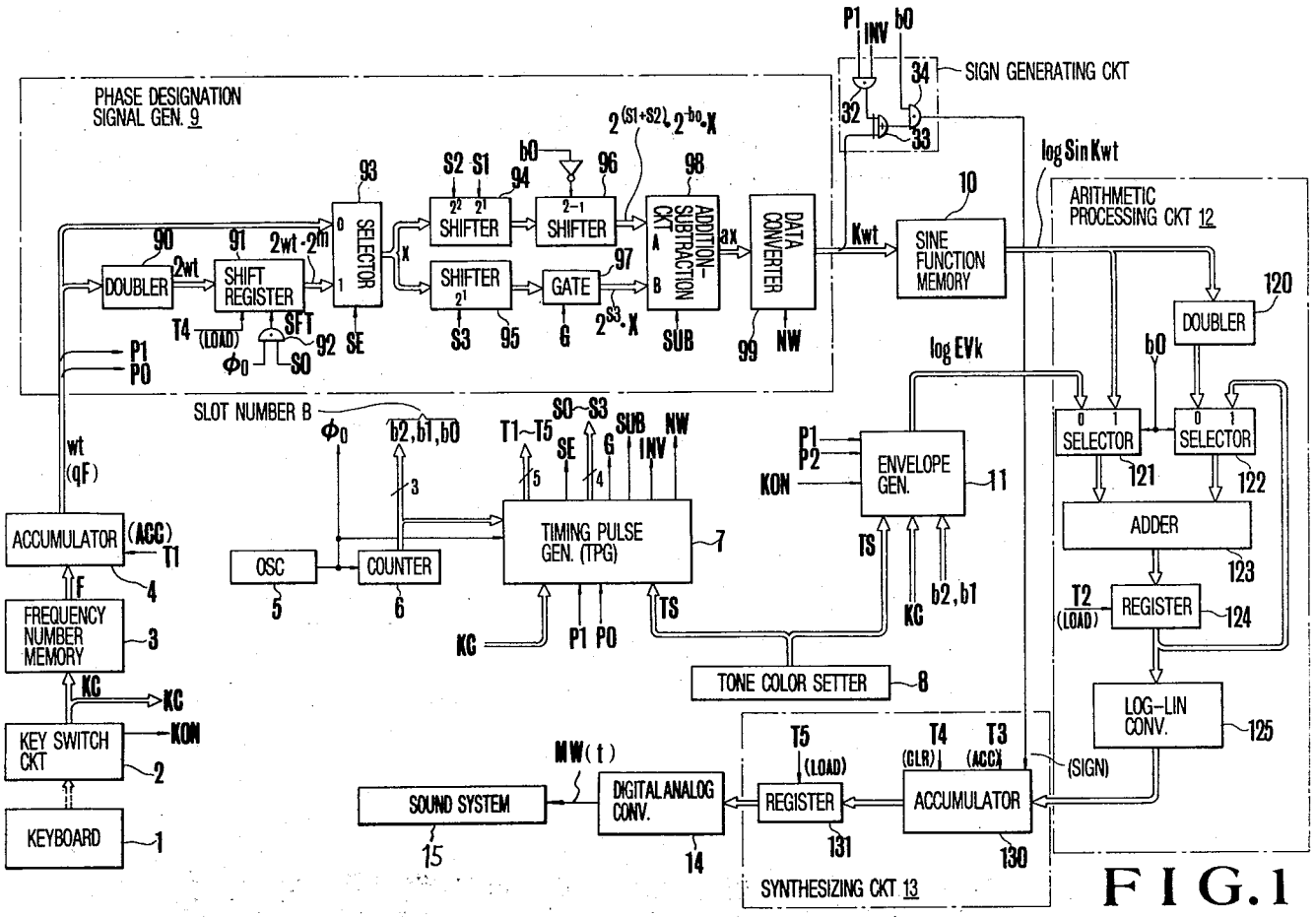
FIG. 1 is a block diagram showing one embodiment of the electronic musical instrument according to this invention.
Figure 2:
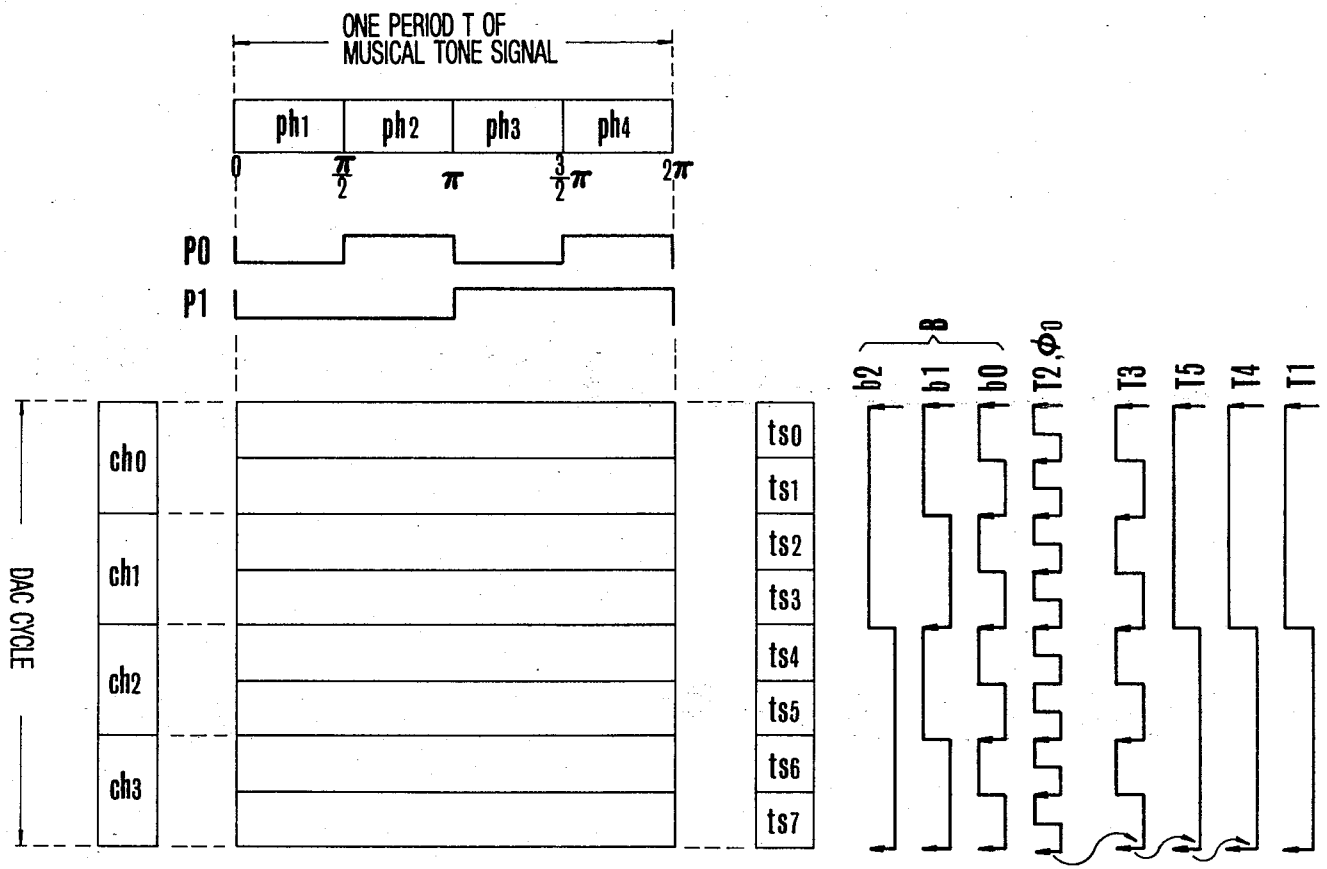
FIG. 2 is a diagram showing the relation between calculating channels for calculating partial tone components and timing pulses.

As shown in FIG. 2, one embodiment of the electronic musical instrument shown in FIG. 1 comprises eight time divisioned time slots ts0 through ts7 of which four pairs of ts0 and ts1; ts2 and ts3; ts4 and ts5; and ts6 and ts7 constitute four partial tone calculating channels ch0 through ch3 which calculate desired partial tone components respectively.

More particularly, in each calculating channel, the fore half time slots (ts0, ts2, ts4 and ts6) produce the time window signal W having desired time width Tw, while the later half time slots (ts1, ts3, ts5 and ts7) produce the kth order frequency signal of a sine waveform having a desired frequency kf (where f represents the frequency of a musical tone signal to be produced and k represents order of a partial tone). Then the time window signal W is multiplied with the kth order frequency signal Hk for calculating partial tone components hkw over a desired bandwidth having the kth order partial tone component hk having a frequency represented by kf as the center component.

In this case, the frequency signal Hk and the time window signal W are generated in the following manner. With regard to the frequency signal Hk, a sine wave signal sin wt (w: angular frequency) of one period (see FIG. 3*a*) is stored in a memory device as a digital value and then a frequency number F corresponding to the tone pitch of a depressed key is sequentially accumulated at a predetermined speed to form an accumulated value qF (q=1, 2, 3 . . . ) having a recurrent frequency same as the frequency f of the tone pitch (the frequency f of the musical tone signal) of the depressed key. The accumulated value qF is applied to an address input of the sine function memory device as a phase designation signal of one period of the sine wave, to read out the sine wave signal sin wt of frequency f from the sine function memory device, the generated sine wave signal sin wt being utilized as a frequency signal Hk. After multiplying a signal wt and k and the product is then applied to the sine function memory device as an address signal, for producing a frequency signal Hk having a frequency of kf as shown in FIG. 3*c*.

Figure 3:
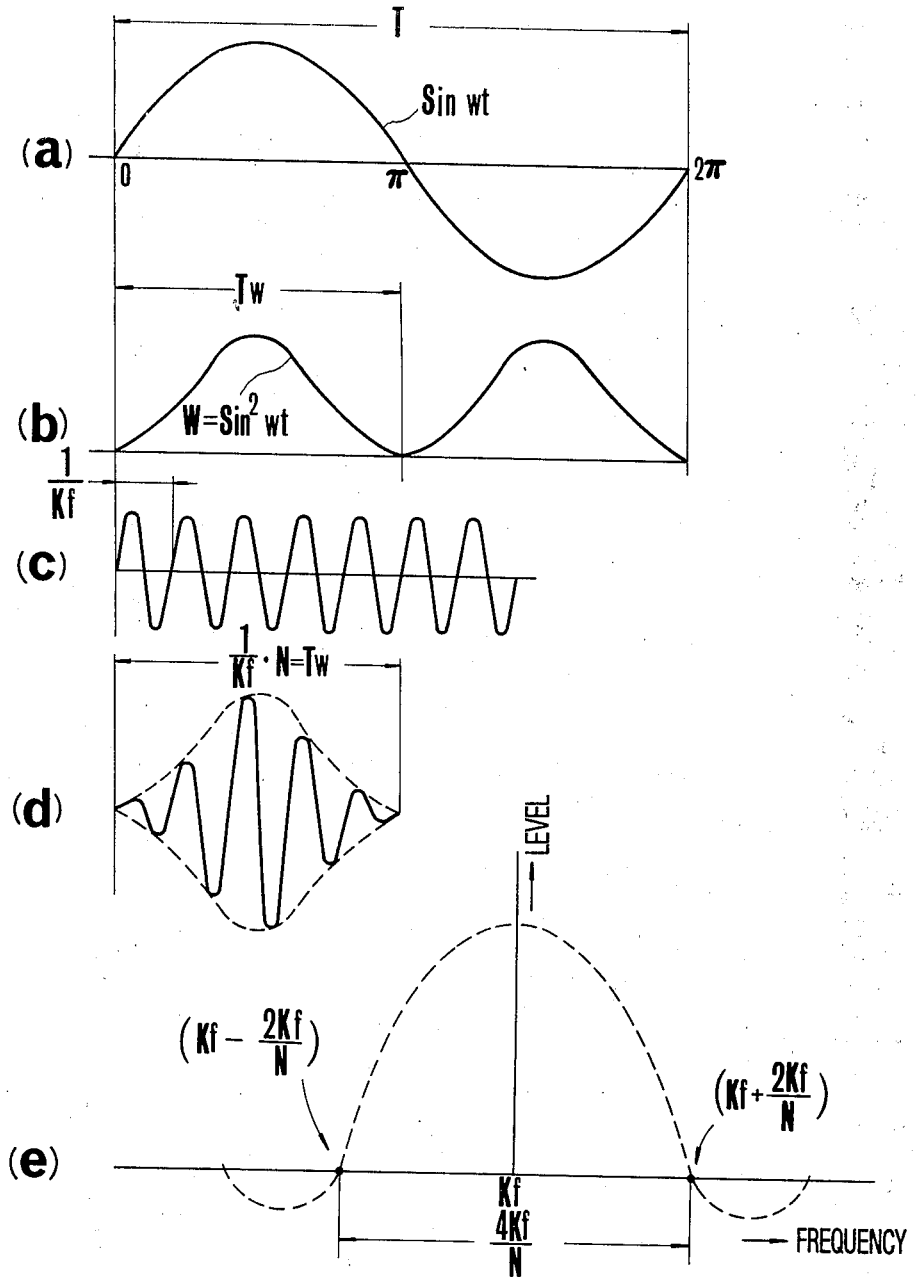
FIG. 3 shows waveforms for explaining a method of forming a time window signal and the kth order frequency signal.

With reference to time window signal W, a signal wt is applied to the sine function memory device as the address signal for reading out the sine wave signal sin wt having a frequency f, and then the sine wave signal sin wt is squared to form a signal $\sin^2$ wt consisting of only positive amplitude components as shown in FIG. 3*b*. The phase portion between 0 to $\pi$ of the signal $\sin^2$ wt is used as the time window signal W. For this reason, the time width Tw of the time window signal W is $\frac{1}{2}$ of one period T of the sine wave signal sin wt. Thus, by varying the period of the sin wave signal sin wt, it is possible to vary the time width Tw of the time window signal W to any value. For example, where signal wt is made to be wt/2, Tw becomes to T, whereas when the signal wt is made to be 2 wt, Tw=T/4, and where wt=kwt, Tw=T/2k. With this control it is possible to cause a single sine function memory device to produce a time window signal W having a desired time width Tw and a frequency signal Hk having a desired frequency kf.

By multiplying the frequency signal Hk thus produced with the time window signal W, an amplitude modulated signal Hkw as shown in FIG. 3*d* can be obtained. It is known that where the time width Tw is made to be equal to N times (N is a positive integer) of the period 1/kf of a frequency signal Hk having a frequency of kf the modulated signal Hkw would have a spectrum envelope having a bandwidth (main lobe) of 4/Tw, that is 4kf/N as the frequency signal Hk of a frequency kf as the center component as shown in FIG. 3*e*. Thus, it will be noted that the modulated signal Hkw is constituted by a number of frequency components distributed over a frequency bandwidth shown by 4kf/N. Accordingly, where the modulated signal Hkw is formed as above described and where the constituent frequency components are used as the partial tone components, a plurality of partial tone components can be calculated at the same time. Since the frequency components constituting the modulated signal Hkw are utilized as the partial tone components, in the following description, the modulated signal Hkw is designated as a partial tone component Hkw.

Figure 4:
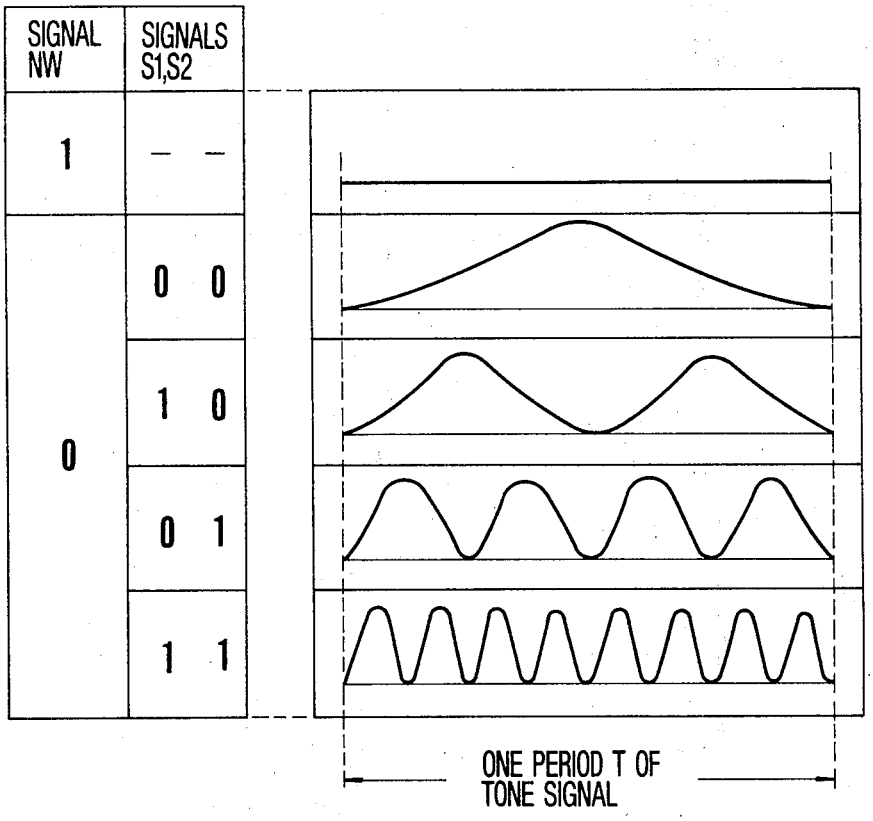
FIG. 4 is a graph for explaining a method of controlling the time width of a time window signal.

The embodiment shown in FIG. 1 is constructed such that the time width Tw of the time window signal W and the frequency kf of the frequency signal Hk are controlled in accordance with the tone color set by a tone color setter and the tone pitch of a depressed key. With regard to the time window signal W, as shown in FIG. 4, a time window signal W having a constant level is produced by controlling signals NW,S1 and S2 to be described later (this is the same as if no time window signal W presents), or a plurality of time window signals W are produced, on the time division basis, in the same calculating channel so as to calculate with the same calculating channel partial tone components hkw over a plurality of groups of frequency bandwidths.

The construction and the operation of the embodiment shown in FIG. 1 will now be described as follows.

The embodiment shown in FIG. 1 comprises a keyboard 1 provided with a plurality of keys, a key switch circuit 2 including a plurality of key switches corresponding to the keys of the keyboard 1 and constructed such that when a certain key is depressed, a key switch corresponding thereto is operated so as to produce a key code KC (comprising an octave code BC representing an octave range and note code NC representing a note name) corresponding to the depressed key, and a key-on signal KON showing that a certain key has been depressed; a frequency number memory device 3 storing in its addresses the frequency numbers F (digital values) corresponding to the tone pitches of respective keys so as to output the frequency number F corresponding to the tone pitch of the depressed key, and an accumulator 4 which sequentially accumulates the frequency number F each time a timing pulse T1 is generated so as to output the accumulated value qF (q=1, 2, 3, . . . ) as a phase designation signal wt for producing a time window signal and partial tone signals. The accumulator 4 is constructed such that the most significant bit signal P1 of the phase designation signal wt outputted therefrom would have the same frequency f (having a period of $T=1/f$) as a musical tone signal to be formed. Accordingly, the most significant bit signal P1 and the next order bit signal P0 of the phase designation bit signal wt outputted from the accumulator 4 can designate respective phase portions ph1 through ph4 obtained by dividing one period T of the musical tone signal into 4 portions, as shown in FIG. 2. When the phase designation signal wt is applied to a sine function memory device as it is, a first frequency signal H1 (=sin wt) of a sine waveform of a frequency f can be obtained, whereas when the signal wt is multiplied with k and then applied to the sine function memory device a kth frequency signal Hk (sin kwt) having a sine waveform of a frequency kf can be obtained.

As shown in FIG. 2, the timing pulse T1 for accumulating the frequency number F is generated by a timing pulse generator 7 (to be described later) each time the time slots ts0 through ts7 circulate one cycle. Accordingly, the phase designation signal wt is updated or changed to a new value each time the time slots ts0 through ts7 (calculating channels ch0 through ch3) make one cycle.

The electronic musical instrument shown in FIG. 1 further comprises an oscillator 5 for producing a clock pulse $\phi$o having a predetermined frequency, a counter 6 which counts the number of the clock pulse $\phi$o for producing a slot number signal B consisting of 3 bit signals b2, b1 and b0 representing the time divisioned time slots ts0 through ts7, and the timing pulse generator 7 which generates various timing pulses (T1, T2, T3, T4, T5, S0, S1, S2, S3, SE, G, INV, NW and SUB) necessary to calculate predetermined partial tone components in the calculating channels ch0 through ch3 corresponding to a set tone color and the tone range of a depressed key in accordance with the clock pulse $\phi$o, the slot number signal B, the key code KC, upper order bit signals P1 and P0 of the phase designation signal wt, and a tone color setting signal Ts representing a tone color selectively set by a tone color setter 8. The relationship among the timing pulses T1 through T5 and the time slots ts0 through ts7 (calculating channels ch0 through ch3) is shown by FIG. 2. The other timing pulses S0 through S3, SE, G, SUB, INV and NW are used to change the phase designation signal wt in accordance with the time width TW of the time window signal W utilized in the calculating channels ch0 through ch3 and the frequency kf of the frequency signal Hf. The number and timings of generation of these timing pulses differ depending upon the set tone color and the tone range of a depressed key. Among various timing pulses, the timing pulse INV becomes "1" in the later half portion of one period of a musical tone signal where the even number ordered partial tone components are eliminated from the musical tone signals formed in respective calculating channels ch0 through ch3 so that musical tone signals containing only the odd number ordered partial tone components are formed. Consequently, musical tone color containing the even and odd number ordered partial tone components is selected, and the timing pulse INV is always "0". The timing pulse NW becomes "1" only when the time window signal W is not produced but a single partial tone component hk is calculated based on the frequency signal HK.

The period in which the time slots ts1 through ts7 (calculating channels ch0 through ch3) circulate constitutes a DAC cycle in which the partial tone components calculated in that period are synthesized and the synthesized value is converted into an instantaneous value MW(t) of an analogue musical tone signal.

There is also provided a phase designation signal generator 9 which changes the phase designation signal wt according to the timing pulses S0 through S3, SE, G, NW and SUB corresponding to the time width Tw of the time window signals W generated in respective calculating channels ch0 through ch3 and the frequency kf of the sine waveform frequency signal kf. The phase designation signal generator 9 is constituted by a doubler 90, a shift register 91, and AND gate circuit 92, a selector 93, shifters 94 through 96, a gate circuit 97, an addition-subtration circuit 98 and a data converter 99. Respective calculating channels ch0 through ch3 are constructed to change the phase designation signals wt with the timing pulses S0 through S3, . . . SUB, for producing phase designation signals kwt as shown in the following Table I.

TABLE I

| | calculating channel | | | |
|---|---|---|---|---|
| | ch0 | ch1 | ch2 | ch3 |
| phase designation signal kwt | ½ wt | ½ wt | ½ wt | ½ wt |
| | wt | wt | wt | wt |
| | 2 wt | 2 wt | 2 wt | 2 wt |
| | 3 wt | 3 wt | 3 wt | 3 wt |
| | 4 wt | 4 wt | 4 wt | 4 wt |
| | 5 wt | 5 wt | 5 wt | 5 wt |
| | 6 wt | 6 wt | 6 wt | 6 wt |
| | 7 wt | 7 wt | 7 wt | 7 wt |
| | 8 wt | 8 wt | 8 wt | 8 wt |
| | 9 wt | 9 wt | 9 wt | 9 wt |
| | 10 wt | 10 wt | 10 wt | 10 wt |
| | 12 wt | 12 wt | 16 wt | 16 wt |
| | 14 wt | 16 wt | 24 wt | 32 wt |
| | 16 wt | 20 wt | 32 wt | 48 wt |
| | 18 wt | 24 wt | 40 wt | 64 wt |
| | 20 wt | 28 wt | 48 wt | 80 wt |
| | | 32 wt | 56 wt | 96 wt |
| | | 36 wt | 64 wt | 112 wt |
| | | 40 wt | 72 wt | 128 wt |
| | | | 80 wt | 144 wt |
| | | | | 160 wt |

In a time slots among time slots ts0, ts2, ts4 and ts6, in which a time window signal W is generated that is calculating channels ch0 through ch3 in which the least significant bit signal b0 of the slot number signal B is "0", let us assume that the relation between the time width Tw of the time window signal W to be generated and the period T of the musical tone signal is expressed by an equation.

$$Tw = T/2k \quad (1)$$

the circuit 9 is constructed to produce a phase designation signal kwt, where k=T/2Tw, so as to read out the sine wave signal stored in the sine function memory device 10 with this phase designation signal.

In this case, although it is possible to set the time width Tw of the time window signal W to any desired value by controlling the phase designation signal kwt, in this embodiment, the time width Tw is limited to those shown in FIG. 4, that is Tw=T, ½T, ¼T and ⅛T. It is also possible to always generate a phase designation signal of a constant, so as to read out a constant amplitude value from the sine function memory device 10 in order not to form a time window signal W. Time window signal W having such various time width can be obtained by making the timing pulses SE and G to be normally "0" thereby controlling the timings of generating the timing pulses S1, S2 and NW.

At this stage, the operation of the phase designation signal generator 9 will be described briefly.

The phase designation signal wt oputputted from the accumulator 4 is applied to an input "0" of the selector 93 and respective bit signals constituting the signal wt are shifted by the doubler 90 one bit toward the upper order bits to become 2wt which is applied to the shift register 91.

The shift register 91 is loaded with the output signal 2wt of the doubler 90 when the timing pulse T4 builds down (when the DAC cycle starts) and shifts one bits towards the upper order bits the loaded signal 2wt each time a shift pulse SFT is applied through the AND gate circuit 92 so as to produce a signal $(2wt)\times(2^m)$ formed by multiplying signal 2wt with 2m according to the number m of generation of the shift pulses SFT. At this time, the number m of generation of the shift pulses SFT is determined by an interval in which the timing pulse S0 is in on "0" state. When this interval corresponds to m periods of the clock pulse $\phi$, m shift pulses SFT are produced by the AND gate circuit 92. Although the timing pulse So may become "1" over the entire period of the time slots ts0 through ts7 at the time of starting the DAC cycle, since a priority is given to the loading of the signal 2wt from the doubler 90 the maximum of the number m of generating shift pulse SFT is seven.

For this reason, signals as shown in the following Table II can be obtained from the shift register 91 by controlling the interval in which the timing pulse So is "1".

TABLE II

| number m of generation of shift pulse SFT | output of shift register ($2\ wt \cdot 2^m$) |
|---|---|
| m = 0 | 2 wt |
| = 1 | 4 wt |
| = 2 | 8 wt |
| = 3 | 16 wt |
| = 4 | 32 wt |
| = 5 | 64 wt |
| = 6 | 128 wt |
| = 7 | 256 wt |

In this embodiment, the maximum number m of generation of the shift pulse SFT is limited to 3.

The phase designation signal $(2wt)\times(2^m)$ outputted from the shift register 91 is applied to an input "1" of the selector 93. Then, the selector 93 selects and outputs the phase designation signal $(2wt)\times(2^m)$ applied to its input "1" when the timing pulse SE is "1", whereas when the timing pulse SE is "0" it selects and outputs the phase designation signal wt applied to its "0" input.

Consequently, the selector 93 produces signals as shown in the following Table III under the control of the timing pulse SE.

TABLE III

| timing pulse SE | number m of generation of shift pulse SFT | output of selector 93 |
|---|---|---|
| "0" | — | wt |
| "1" | m = 0 | 2 wt |
| | = 1 | 4 wt |
| | = 2 | 8 wt |
| | = 3 | 16 wt |

By denoting all phase designation signals (wt, 2wt, 4wt, 8wt and 16wt) outputted from the selector 93 by $\chi$, this phase designation signal $\chi$ is multiplied with $2^{(S1+S2)}$ in the shifter 94 under the control of the timing pulses S1 and S2 to be changed into a phase designation signal $2^{(S1+S2)}x(\chi)$ as shown in the following Table IV, and multiplied with $2^{s3}$ in the shifter 95 under the control of the timing pulse S2 to be changed into phase designation signals $2^{s3}$ as shown in the following Table V under the control of the timing pulse S3.

TABLE IV

| timing pulse S2 | timing pulse S1 | output of shifter 94 $2^{(s1+s2)}\times(x)$ |
|---|---|---|
| 0 | 0 | $2^0\times(x)$ |
| 0 | 1 | $2^1\times(x)$ |
| 1 | 0 | $2^2\times(x)$ |
| 1 | 1 | $2^3\times(x)$ |

TABLE V

| timing pulse S3 | output of shifter 95 $2^{s3}\times(x)$ |
|---|---|
| 0 | $2^0\times(x)$ |
| 1 | $2^1\times(x)$ |

Further, the output signal $2^{(S1+S2)}x(\chi)$ of the shifter 94 is multiplied with $2^{-b0}$ in the shifter 96 under the control of the least significant signal b0 of the slot number signal B to be changed into phase designation signals $[2^{(s1+s2)}]\times(2^{-b0})\times(\chi)$ as shown in the following Table VI. In other words, the output signal $2^{(s1+s2)}\times(\chi)$ of the shifter 94 is multiplied with $\frac{1}{2}$ in a time slot (ts0, ts2, ts4, ts6; signal b0 becomes "0") utilized to generate the time window signal W.

TABLE VI

| slot number signal b0 | output of shifter 96 $[2^{s1+s2}]\times(2^{-b0})\times(x)$ |
|---|---|
| 0 | $[\frac{1}{2}(2^{s1+s2})]\times(x)$ |
| 1 | $[2^{(s1+s2)}]\times(x)$ |

And the output signal $[2^{s1+s2)}]\times(2^{-b0})\times(\chi)$ of the shifter 96 is applied to the input A of the addition-subtraction circuit 98.

On the other hand, the output signal $S^{s3}\times(\chi)$ of the shifter 95 is applied to the B input of the addition-subtraction circuit 98 via the gate circuit 97 only when the timing pulse G is "1", where it is added to or subtracted from the signal $[2^{(s1+s2)}]\times(2^{-b0})\times(\chi)$ supplied to the A input under the control of the timing pulse SUB.

Consequently, the addition-subtraction circuit 98 outputs a phase designation signal ax as shown in the following Table VII. The addition-subtraction circuit 98 executes a subtraction operation A-B when the timing pulse SUB is "1".

Since this embodiment is constructed such that when the signal b0 is "0", the timing pulse G would be always "0", when the signal b0 is "0" (the time slot in which the time window signal is generated) the output signal $(\frac{1}{2})\times[2^{(s1+s2)}]\times(\chi)$ of the shifter 96 is outputted as it is through the addition-subtraction circuit 98 to act as the phase designation signal ax.

TABLE VII

| b0 | timing pulse S1 | S2 | G | S3 | SUB | output ax of addition-subtraction circuit 98 |
|---|---|---|---|---|---|---|
| 1 | 0 | 0 | 0 | 0 | 0 | x |
| | 1 | 0 | 0 | 0 | 0 | 2x |
| | 1 | 0 | 1 | 0 | 0 | 3x (= 2x + x) |
| | 0 | 1 | 0 | 0 | 0 | 4x |
| | 0 | 1 | 1 | 0 | 0 | 5x (= 4x + x) |
| | 0 | 1 | 1 | 1 | 0 | 6x (= 4x + 2x) |
| | 1 | 1 | 1 | 0 | 1 | 7x (8x − x) |
| | 1 | 1 | 0 | 0 | 0 | 8x |
| | 1 | 1 | 1 | 0 | 0 | 9x (= 8x +x) |
| | 1 | 1 | 1 | 1 | 0 | 10x (= 8x +2x) |
| 0 | 0 | 0 | 0 | — | — | ½x |
| | 0 | 1 | 0 | — | — | x |
| | 1 | 0 | 0 | — | — | 2x |
| | 1 | 1 | 0 | — | — | 4x |

The output signal ax of the addition-subtraction circuit 98 is applied to a data converter 99 which is supplied with a timing pulse NW acting as a control signal, so that the data converter 99 produces a constant value $\alpha$ irrespective of the value of the input signal ax so long as the timing pulse NW is "1", whereas when the timing pulse NW is "0" the data converter 99 produces the input signal ax as it is. In this case, the timing pulse NW becomes "1" only in the time slot utilized to generate the time window signal W of a given channel when calculating channels ch0 through ch3 are not utilized to generate the time window signal W (see FIG. 4). Consequently the data converter 99 normally produces the output signal ax of the addition-subtraction circuit 98 as it is as the phase designation signal kwt, whereas when the timing pulse NW becomes "1" in a time slot utilized to generate the time window signal, a constant value $\alpha$ is outputted as the phase designation signal kwt.

Where the number m of the shift pulses SFT outputted from the AND gate circuit 92 is determined as shown in the following Table VIII for respective channels ch0 through ch3, phase designation signals kwt as shown in Table I can be obtained from the addition-subtraction circuit 98 by controlling the generation of the timing pulses S1, S2, S3, G and SUB.

TABLE VIII

| calculating channel | m |
|---|---|
| ch0 | 0 |
| ch1 | 1 |
| ch2 | 2 |
| ch3 | 3 |

Turning back to FIG. 1, there is provided a sine function memory device which stores in its respective addresses sine amplitude values in terms of logarithms at respective sampling points in one period of a sine waveform signal as shown in FIG. 3*a*, and produces a sine amplitude value log (sin kwt) having a phase corresponding to a signal kwt when supplied with a phase designation signal kwt from the phase designation signal generator 9 to act as an address signal.

There is provided an envelope generator 11 which produces a logarithmic envelope signal log EVK adapted to impart an amplitude envelope for respective partial tone components calculated in respective calculating channels ch0 through ch3 based on the upper order bit signals P1 and P2 of the phase designation signal wt, the upper order bit signals b2 and b1, the tone color setting signal TS, the key code KC and the key-on signal KON.

An arithmetic processing circuit 12 is provided for calculating a time window signal amplitude value 2 log (sin kwt) having a waveform as shown in FIG. 3*b* by doubling a sine amplitude value log (sin kwt) outputted from the sine function memory device 10 in the fore half time slots ts0, ts2, ts4 and ts6 of resective calculating channels ch0 through ch3. Further the arithmetic processing circuit 12 adds the sine amplitude value log (sin kwt) outputted from the sine function memory device 10 in the later half time slots (ts1, ts3, ts5 and ts7) of respective calculating channels ch0 through ch3 to the time window signal amplitude value 2 log (sin kwt) for calculating partial tone components distributing over a frequency handwidth shown by 4 kf/N and having the frequency kf at the center, and further adds the envelope signal log EVK to the partial tone components hkw for controlling the amplitude envelope. The arithmetic processing circuit 12 is constituted by a doubler 120, selectors 121 and 122, an adder 123, a register 124, and a logarithm-natural number (LOG-LIN) converter 125. In this case, the partial tone component outputted from the LOG-LIN converter 125 for respective calculating channels ch0 through ch3 are expressed by the following equation $$hkw=(\sin^2 kwt)\times(EVK)\times(\sin kwt) \quad (3)$$

A synthesizer circuit 13 is provided for synthesizing partial tone components hkw respectively calculated in the calculating channels ch0 through ch3. The synthesizer circuit 13 is constituted by an accumulator 130 which sequentially accumulates the partial tone components hkw for respective calculating channels ch3 through ch0 at the time of building down of the timing pulse T3, and a register 131 which is loaded with the accumulated value Σhkw produced by the accumulator 130 when the timing pulse T5 builds down and holds the loaded accumulated value until a next new accumulated value Σhkw is given. The content of the accumulator 130 is reset or cleared when the timing pulse T4 slightly lagged than the timing pulse T5 builds down and the output Σhkw of the synthesizing circuit 13 is converted into an analogue musical tone signal instantaneous value MW(t) by a digital-analogue converter 14 and then supplied to a sound system 15.

In this embodiment, there is provided a circuit which designates the fact that the polarities of the partial tone components calculated in the later half portion of one period of the musical tone signal should be inverted when the partial tone components are synthesized in each DAC cycle. This circuit comprises an AND gate circuit 32, an exclusive OR gate circuit 33 and an AND gate circuit 34 which are bounded by dotts and dash lines as shown in FIG. 1. When the timing pulse INV is "1" in the later half portion of one period of the musical tone signal in which the most significant bit signal P1 of the phase designation signal wt is "1", as well as the later half time slots of respective calculating channels ch0 through ch3, this circuit inverts the polarity of the most significant bit signal of the phase designation signal kwt outputted from the data converter 99 and applied the inverted signal to a sign bit input of the accumulator 130. Accordingly, the accumulator 130 synthesizes respective partial tone signals after inverting their polarities. When one period of a musical tone signal is considered continuously, only the even number ordered components are eliminated with the result that a musical tone signal consisting of only the odd number ordered components would be produced.

Even in the normal fore half and later half portions, when the signal INV is "0" (that is not inverted), the most significant bit of the signal kwt would be inputted to the sign bit input of the accumulator 130 as it is.

Figure 7:
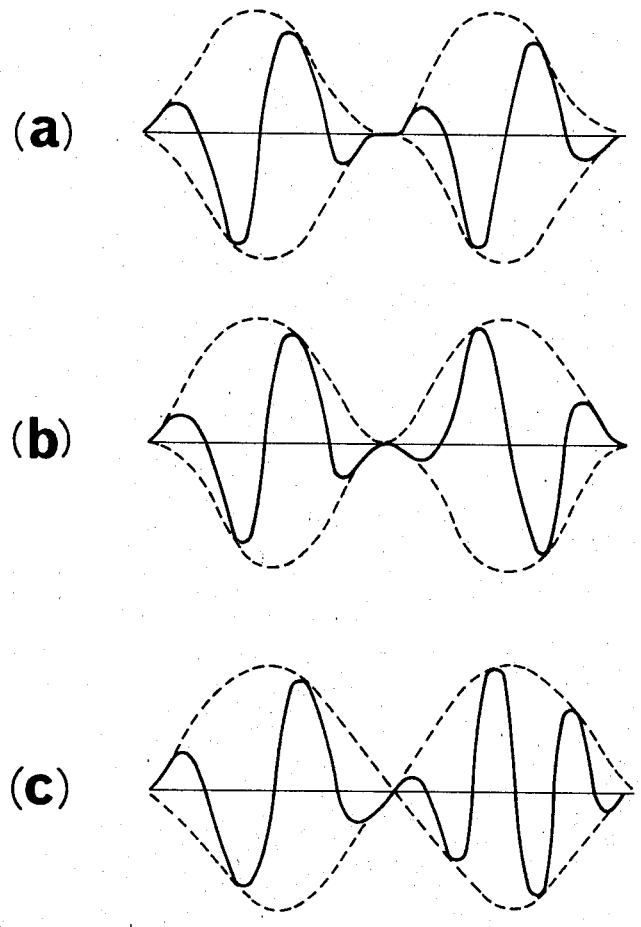
FIG. 7 shows waveforms for explaining elimination or suppression of even number ordered components.

For example, as shown in FIG. 7*a*, a musical tone signal waveform which is point-symmetrical in the fore half and later half portions of one period of the musical tone signal contains both the even number ordered components and the odd number ordered components. However when the polarity of the later half waveform is inverted, the waveform of the musical tone signal would be shown by FIG. 7*b*. In other words, the waveform of the musical signal tone waveform is line-symmetrical, and the fore half portion of one period is generally expressed by $$\Sigma An \sin nwt \quad (4)$$

while the later half portion by $$\begin{aligned} &-\Sigma An\sin(nwt - n\pi) \quad (5)\\ &= -\Sigma An[(\sin nwt)\times(\cos n\pi) - (\cos nwt)\times(\sin n\pi)]\\ &= -\Sigma An[(\sin nwt)\times(-1)^n]\\ &= \Sigma(-1)^{n+1}\times(An\sin nwt) \end{aligned}$$

By synthesizing equations (4) and (5), we obtain $$\begin{aligned} &\Sigma An\sin nwt + \Sigma(-1)^{n+1}An\sin nwt\\ &= A1\sin wt + A2\sin 2wt + A3\sin 3wt\\ &+ A4\sin 4wt + A5\sin 5wt \ldots\\ &+ A1\sin wt - A2\sin 2wt + A3\sin 3wt\\ &- A4\sin 4wt + A5\sin 5wt \end{aligned}$$

In this equation, the even number ordered components are eliminated and finally it becomes $$2[A1\sin + A3\sin 3wt + A5\sin 5wt \ldots] \quad (6)$$

Consequently, a musical tone signal waveform as shown in FIG. 7*b* is eliminated with even number ordered components, that is it contains only the odd number ordered components. In this case, as shown in FIG. 7*c*, even when the fore and later half portions of one period of the musical tone signal are not perfect line-symmetrical so long as the even number ordered components present in both half portions, by synthesizing the later half portion after inverting its sign the even number ordered components would be suppressed. This is extremely efficient when forming a tone of such pipe instrument as a clarinette.

The operation of the electronic musical instrument constructed as above described is as follows:

After closing a source switch, not shown, the counter 6 and the timing pulse signal generator 7 produce slot number signals B (b2, b1, b0) and timing pulse signals T1 through T5. Under these states, when the performer depresses a key on the keyboard 1 after setting a desired tone color with the tone color setter 8, a frequency number F corresponding to the tone pitch of the depressed key is read out from the frequency number memory device 3. Then, the accmulator 4 sequentially accumulates the read out frequency number F at a period of generating the timing pulse T1, and outputs its accumulated value qF as a phase designation signal wt for producing a time window signal and a sine waveform partial tone signal.

The upper order bit signals P1 and P0 of the phase designation signal wt is applied to the timing pulse generator 7 and to the envelope generator 11 to act as signals for designating the first to the fourth phase portions ph 1 through ph4 formed by dividing one period T of a musical tone signal with 4. Accordingly, the timing pulse generator 7 produces timing pulses S0 through S3, SE, . . . SUB utilized to calculate predetermined partial tone components corresponding to the set color and the tone range of the depressed key in respective calculating channels in respective phase portions ph1 through ph4 of one period of the musical tone signal. The phase designation signal wt outputted from the accumulator 4 is changed in the phase designation signal generator 9 under the control of the timing pulses S0 through S3, . . . SUB.

Figure 5:
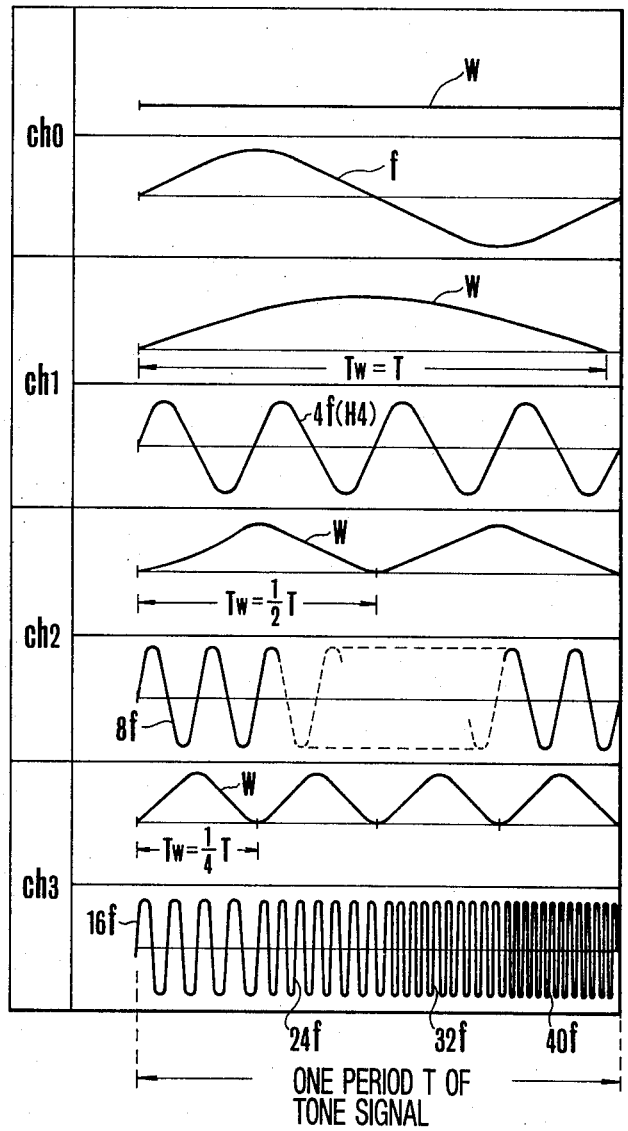
FIG. 5 shows one example of the waveforms of the time window signals and the frequency signals generated in respective calculating channels.

To simplify the description it is assumed that respective calculating channels ch0 through ch3 calculate partial tone components hkw based on a time window signal W and a frequency signal Hk as shown in FIG. 5. More particularly, the calculating channel ch0 calculates the first order partial tone component h1 by multiplying a time window signal W usually at a constant level with a frequency signal H1 having a frequency of f. In the calculating channel ch1, a time window signal W having a time width of $Tw=T$ is multiplied with a frequency signal H4 having a frequency of 4f to calculate a partial tone component h4w, the width M of its main lobe distributing over a frequency bandwidth expressed by $$M=(4)\times(4f)/4$$

and having the fourth order partial tone component h4 (having a frequency of 4f) as the center component.

In the calculating channel ch2, two time window signals W respectively having time widths of $Tw=(\frac{1}{2})\times(T)$ in fore half portion (ph1 and ph2) and later half portion (ph3 and ph4) of one period T of the musical tone signal are produced, and respective time window signals W are multiplied with a frequency signal H8 having a frequency of 8f so as to calculate a partial tone component h8w distributing over a frequency bandwidth and having the 8th order partial tone component h8 (having a frequency of 8f) as the center component, the main lobe width M of the frequency bandwidth being shown by $$M=(4)\times(8f)/4$$

In the calculating channel ch3, a time window signal W having a time width $Tw=(\frac{1}{4})\times(T)$ is produced in each of the phase portion ph1 through ph4 in one period T of the musical tone signal, and the time window signal W in the first phase portion ph1 is multiplied with a frequency signal H16 having a frequency of 16f to calculate a partial tone component h16w distributing over a frequency bandwidth having the 16th order partial tone component h16 as the center component, the main lobe width M of the frequency bandwidth being expressed by an equation $$M=(4)\times(16f)/4$$

whereas the time window signal W in the second phase portion ph2 is multiplied with a frequency signal H24 having a frequency of 24f to calculate a partial tone component h24w distributing over a frequency bandwidth having the 24th order partial tone component h24 as the center component, the main lobe width M of the frequency bandwidth being shown by an equation $$M=(4)\times(24f)/4$$

The time window signal W in the third phase portion ph3 is multiplied with a frequency signal H32 having a frequency of 32f to calculate a partial tone component h32w distributing over a frequency bandwidth having the 32th order partial tone component h32 as the center component, the main lobe width M of the frequency bandwidth being shown by an equation $$M=(4)\times(32f)/8$$

In the same manner, the time window signal W in the fourth phase portion ph4 is multiplied with a frequency signal H40 having a frequency of 40f to calculate a partial tone component h40w distributing over a frequency handwidth having the 40th order partial tone component h40 as the center component, the main lobe width M of the frequency bandwidth being expressed by an equation $$M=(4)\times(40f)/4$$

Where the partial tone components hkw to be calculated in respective calculating channels ch0 through ch3 are those described above, the timing pulse generator 7 produces timing pulses as shown in the following Table 9a through 9d in the fore and later half time slots of respective calculating channels ch0 through ch3 during an interval between the first to the fourth phase portions ph1 through ph4 of one period T of the musical tone signal.

TABLE IX a

| phase component | calculating channel | time slot | timing pulse | | | | | | | | |
|---|---|---|---|---|---|---|---|---|---|---|---|
| | | | S0 | SE | S1 | S2 | S3 | G | SUB | NW | INV |
| ph 1 | ch0 | ts0 | 0 | 0 | 0 | 0 | 0 | 0 | 0 | 1 | 0 |
| | | ts1 | 1 | 0 | 0 | 0 | 0 | 0 | 0 | 0 | 0 |
| | ch1 | ts2 | 0 | 0 | 0 | 0 | 0 | 0 | 0 | 0 | 0 |
| | | ts3 | 1 | 0 | 0 | 1 | 0 | 0 | 0 | 0 | 0 |
| | ch2 | ts4 | 0 | 0 | 1 | 0 | 0 | 0 | 0 | 0 | 0 |
| | | ts5 | 1 | 1 | 0 | 0 | 0 | 0 | 0 | 0 | 0 |

TABLE IX a-continued

| phase component | calculating channel | time slot | timing pulse S0 | SE | S1 | S2 | S3 | G | SUB | NW | INV |
|---|---|---|---|---|---|---|---|---|---|---|---|
| | ch3 | ts6 | 0 | 0 | 0 | 1 | 0 | 0 | 0 | 0 | 0 |
| | | ts7 | 0 | 1 | 0 | 0 | 0 | 0 | 0 | 0 | 0 |

TABLE XI b

| phase component | calculating channel | time slot | timing pulse S0 | SE | S1 | S2 | S3 | G | SUB | NW | INV |
|---|---|---|---|---|---|---|---|---|---|---|---|
| ph 2 | ch0 | ts0 | 0 | 0 | 0 | 0 | 0 | 0 | 0 | 1 | 0 |
| | | ts1 | 0 | 0 | 0 | 0 | 0 | 0 | 0 | 0 | 0 |
| | ch1 | ts2 | 0 | 0 | 0 | 0 | 0 | 0 | 0 | 0 | 0 |
| | | ts3 | 0 | 0 | 0 | 1 | 0 | 0 | 0 | 0 | 0 |
| | ch2 | ts4 | 0 | 0 | 1 | 0 | 0 | 0 | 0 | 0 | 0 |
| | | ts5 | 1 | 1 | 1 | 0 | 0 | 0 | 0 | 0 | 0 |
| | ch3 | ts6 | 0 | 0 | 0 | 1 | 0 | 0 | 0 | 0 | 0 |
| | | ts7 | 1 | 1 | 1 | 0 | 0 | 1 | 0 | 0 | 0 |

TABLE IX c

| phase component | calculating channel | time slot | timing pulse S0 | SE | S1 | S2 | S3 | G | SUB | NW | INV |
|---|---|---|---|---|---|---|---|---|---|---|---|
| ph 3 | ch0 | ts0 | 0 | 0 | 0 | 0 | 0 | 0 | 0 | 1 | 0 |
| | | ts1 | 0 | 0 | 0 | 0 | 0 | 0 | 0 | 0 | 0 |
| | ch1 | ts2 | 0 | 0 | 0 | 0 | 0 | 0 | 0 | 0 | 0 |
| | | ts3 | 1 | 0 | 0 | 1 | 0 | 0 | 0 | 0 | 0 |
| | ch2 | ts4 | 0 | 0 | 1 | 0 | 0 | 0 | 0 | 0 | 0 |
| | | ts5 | 1 | 1 | 0 | 0 | 0 | 0 | 0 | 0 | 0 |
| | ch3 | ts6 | 0 | 0 | 0 | 1 | 0 | 0 | 0 | 0 | 0 |
| | | ts7 | 1 | 1 | 1 | 0 | 0 | 0 | 0 | 0 | 0 |

TABLE IX d

| phase component | calculating channel | time slot | timing pulse S0 | SE | S1 | S2 | S3 | G | SUB | NW | INV |
|---|---|---|---|---|---|---|---|---|---|---|---|
| ph 4 | ch0 | ts0 | 0 | 0 | 0 | 0 | 0 | 0 | 0 | 1 | 0 |
| | | ts1 | 0 | 0 | 0 | 0 | 0 | 0 | 0 | 0 | 0 |
| | ch1 | ts2 | 0 | 0 | 0 | 0 | 0 | 0 | 0 | 0 | 0 |
| | | ts3 | 0 | 0 | 0 | 1 | 0 | 0 | 0 | 0 | 0 |
| | ch2 | ts4 | 0 | 0 | 1 | 0 | 0 | 0 | 0 | 0 | 0 |
| | | ts5 | 1 | 1 | 0 | 0 | 0 | 0 | 0 | 0 | 0 |
| | ch3 | ts6 | 0 | 0 | 0 | 1 | 0 | 0 | 0 | 0 | 0 |
| | | ts7 | 1 | 1 | 0 | 1 | 0 | 1 | 0 | 0 | 0 |

Then, in the time slot Ts0 of the calculating channel ch0, among the timing pulses So through INV, only the pulse NW is "1" over the first to fourth phase portions ph1 through ph4 and the other pulses are all "0". For this reason, the data converter 99 of the phase designation signal generator 9 produces a constant value $\alpha$ as a phase designation signal kwt irrespective of the signal inputted thereto, whereby the sine amplitude value log (sin kwt) outputted from the sine function memory device 10 is also a constant value Log (sin $\alpha$). This constant sine amplitude value log (sin $\alpha$) is doubled by the doubler 120 of the arithmetic processing circuit 12 to become 2 log (sin $\alpha$) which is applied to the "0" input of the selector 122. At this time the envelope generator 11 produces an envelope signal log EV1 (k=1) for the partial tone component h1 to be calculated in the calculating channel ch0 and the envelope signal log EV1 is applied to the "0" input of the selector 121 of the arithmetic processing circuit 12. At this time, since the time slot produces the time window signal W, the least significant bit signal b0 of the slot number signal B is "0", as that the envelope signal log EV1 and the constant sine amplitude value 2 log (sin $\alpha$) are supplied to the "0" inputs of the selectors 121 and 122 respectively are selected and outputted and applied to the adder 123 whereby the adder 123 processes the following addition operation.

$$\log EV1 + 2 \log (\sin \alpha)$$

This sum is loaded into the register 124 when the timing pulse T2 builds down, and then fedback to the "1" input of the selector 122 from the output terminal of the register 124.

Thereafter, in the time slot ts1, timing pulses S0 through INV are all "0". For this reason, various circuits of the phase designating signal generator 9 produce signal as shown in the following Table X.

TABLE X

| circuit | output signal |
|---|---|
| selector 93 | wt |
| shifter 94 | wt |
| shifter 95 | wt |
| shifter 96 | wt |

TABLE X-continued

| circuit | output signal |
|---|---|
| gate circuit 97 | 0 |
| addition-subtraction circuit 98 | wt |
| data converter 99 | wt |

Thus, a sine amplitude value log (sin wt) in which K=1 is read out from the sine function memory device 10. More particularly, the first order frequency signal H1 (=log sin wt) is outputted and applied to the "1" input of the selector 121 of the arithmetic processing circuit 12. At this time, since the least significant bit signal b0 of the slot number signal B is "1", the selector 121 selects and outputs the first order frequency signal H1 applied to its "1" input. Also the selector 122 selects and outputs the signal [log EV1+2 log (sin )] applied to its "1" input, whereby the adder 123 performs the following addition operation $$[\log Ev1+2\log(\sin\alpha)]+\log(\sin wt)$$

This means that the first order frequency signal H1 [=log (sin wt)] is multipled with the envelope signal EV1. The sum output of the adder 123 is loaded into the register 124 at the time of building down of the timing pulse T2 and then applied to the LOG-LIN converter 125 to be converted thereby into a value "EV1)-$\times(\alpha)^2\times$(sin wt)" expressed by a natural number, and then applied to the accumulator 130 of the synthesizing circuit 13 to be accumulated each time the timing pulse T3 builds down Consequently, in the calculating channel ch0, the first partial tone component h1 imparted with an envelope is calculated.

In the time slot ts2 of the calculating channel ch1, timing pulses S0 through INV are all "0", and the least significant bit signal b0 of the time slot number signal B is "0".

Accordingly, various circuits of the phase designation signal generator 9 produce signals as shown in the following Table XI.

TABLE IX

| circuit | output signal |
|---|---|
| selector 93 | wt |
| shifter 94 | wt |
| shifter 95 | wt |
| shifter 96 | wt/2 |
| gate circuit 97 | 0 |
| addition-subtraction circuit 98 | wt/2 |
| data converter 99 | wt/2 |

More particularly, in the time slot ts2 the value of the phase designation signal wt of a frequency of f is multiplied with ½ and then outputted. Accordingly, a sine amplitude value log (sin wt/2) having a frequency of wT/2 is read out from the sine function memory device 10. This sine function amplitude value log (sin wt/2) is doubled in the doubler 120 of the arithmetic processing circuit 12 and outputted as a time window signal W as shown in FIG. 3*b*. In this case, the time window signal W has a time width Tw=1/f=T This time width signal W having a time width of Tw=T is applied to the adder 123 via the selector 122 to be added to the envelope signal log EV4 (k=4) supplied to the adder 123 via the selector 121, and the sum $$\log EW4+\log W=\log EV4+2\log(\sin wt/2)$$

is temporarily stored in the register 124.

In the next time slot ts3, the timing pulses S0 and S2 become "1" so that various circuits of the phase designation signal circuit 9 produce signals as shown in the following Table XII.

TABLE XII

| circuit | output signal |
|---|---|
| selector 93 | wt |
| shifter 94 | 4wt |
| shifter 95 | wt |
| shifter 96 | 4wt |
| gate circuit 97 | 0 |
| addition-subtraction circuit 98 | 4wt |
| data converter 99 | 4wt |

Thus, a sine amplitude value log (sin 4 wt) in which k=4 would be read out of the sine function memory device 10 thereby producing the fourth order frequency number signal H4[=log (sin 4 wt)] which is added to the signal [log $EV4+2\log\sin wt/2$)] temporarily stored in the register 124 of the arithmetical processing circuit 12. Accordingly, the fourth order frequency signal H4 [=log (sin 4 wt)] is multiplied with the envelope signal EV4 and the time window signal w having a time width of Tw=T.

Accordingly, in this calculating channel ch1, a signal obtained by amplitude modulating the first order frequency signal H1 with the time window signal W having a time width of Tw=T and with the envelope signal EV4. In other words, it is possible to obtain a partial tone component h4w distributing over a frequency bandwidth having the first order partial tone component h4 as the center component and an envelope width M expressed by an equation $$M=(4)\times(4f)/4$$

The output [log EV4+2 log wt/2+log (sin 4wt)] of the adder 123 is applied to the LOG-LIN converter 125 through the register 124, and after being converted into a value [(EV4)$\times(\sin^2$ wt/2)$\times$(sin 4wt)] in terms of a natural number it is applied to the accumulator 130 of the synthesizing circuit 13 to be synthesized with the first order partial tone component h1 calculated in the previous calculating channel ch0.

In the calculating channels ch2 and ch3 predetermined partial tone components hkw are calculated in the same manner. Various signals outputted in this case are shown in the following Tables XIII through XVII. Although detailed description thereof is believed unnecessary regarding the calculating channels, the operatios are different for phase portions ph1 through ph4.

TABLE XIII

| [calculating channel ch2] | | |
|---|---|---|
| | output signal | |
| circuit | ts4 | ts5 |
| shift register 91 | 4wt | 8wt |
| selector 93 | wt | 8wt |
| shifter 94 | 2wt | 8wt |
| shifter 95 | wt | 8wt |
| shifter 96 | wt | 8wt |
| gate circuit 97 | 0 | 0 |
| addition- | wt | 8wt |

TABLE XIII-continued

[calculating channel ch2]

| circuit | output signal ts4 | ts5 |
|---|---|---|
| subtraction circuit 98 | | |
| data converter 99 | wt | 8wt |
| sine function memory | log (sin wt) | log (sin 8wt) |
| envelope generator 11 | log EV8 | log EV8 |
| doubler 120 | 2log (sin wt) | — |
| adder 123 | log EV8 + 2log (sin wt) | log EV8 + 2log (sin wt) + log (sin 8wt) |
| register 124 | log EV8 + 2log (sin wt) | log Ev8 + 2log (sin wt) + log (sin 8wt) |
| LOG-LIN converter 125 | | (EV8) × ($\sin^2$ wt) × (sin 8wt) |

TABLE XIV

[phase portion ph1 of calculating channel ch3]

| circuit | output signal ts6 | ts7 |
|---|---|---|
| shift register 91 | 16wt | 16wt |
| selector 93 | wt | 16wt |
| shifter 94 | 4wt | 16wt |
| shifter 95 | wt | 16wt |
| shifter 96 | 2wt | 16wt |
| gate circuit 97 | 0 | 0 |
| addition-subtraction circuit 98 | 2wt | 16wt |
| data converter 99 | 2wt | 16wt |
| sine function memory | log (sin 2wt) | log (sin 16wt) |
| envelope generator 11 | log EV16 | log EV16 |
| doubler 120 | 2log (sin 2wt) | — |
| adder 123 | log EV16 + 2log (sin 2wt) | log EV16 + 2log (sin 2wt) + log (sin 16wt) |
| register 124 | log EV16 + 2log (sin 2wt) | log EV16 + 2log (sin 2wt) + log (sin 16wt) |
| LOG-LIN converter 125 | | (EV16) × ($\sin^2$ 2wt) × (sin 16wt) |

TABLE XV

[phase portion ph2 of calculating channel ch3]

| circuit | output signal ts6 | ts7 |
|---|---|---|
| shift register 91 | 4wt | 8wt |
| selector 93 | wt | 8wt |
| shifter 94 | 4wt | 16wt |
| shifter 95 | wt | 8wt |
| shifter 96 | 2wt | 16wt |
| gate circuit 97 | 0 | 8wt |
| addition-subtraction circuit 98 | 2wt | 24wt |
| data converter 99 | 2wt | 24wt |
| sine function memory | log (sin 2wt) | log (sin 24wt) |
| envelope generator 11 | log EV24 | log EV24 |
| doubler 120 | 2log (sin 2wt) | — |
| adder 123 | log EV24 + 2log (sin 2wt) | log EV24 + 2log (sin 2wt) + log (sin 24wt) |
| register 124 | log EV24 + 2log (sin 2wt) | log EV24 + 2log (sin 2wt) + log (sin 24wt) |
| LOG-LIN converter 125 | | (EV24) × ($\sin^2$ 2wt) × (sin 24wt) |

TABLE XV-continued

[phase portion ph2 of calculating channel ch3]

| circuit | output signal ts6 | ts7 |
|---|---|---|
| converter 125 | | × (sin 24wt) |

TABLE XVI

[phase portion ph3 of calculating channel ch3]

| circuit | output signal ts6 | ts7 |
|---|---|---|
| shift register 91 | 16wt | 16wt |
| selector 93 | wt | 16wt |
| shifter 94 | 4wt | 32wt |
| shifter 95 | wt | 16wt |
| shifter 96 | 2wt | 32wt |
| gate circuit 97 | 0 | 0 |
| addition-subtraction circuit 98 | 2wt | 32wt |
| data converter 99 | 2wt | 32wt |
| sine function memory | log (sin 2wt) | log (sin 32wt) |
| envelope generator 11 | log EV32 | log Ev32 |
| doubler 120 | 2log (sin 2wt) | — |
| adder 123 | log EV32 + 2log (sin 2wt) | log EV32 + 2log (sin 2wt) + log (sin 32wt) |
| register 124 | log EV32 + 2log (sin 2wt) | log EV32 + 2log (sin 2wt) + log (sin 32wt) |
| LOG-LIN converter 125 | | (EV32) × ($\sin^2$ 2wt) × (sin 32wt) |

TABLE XVII

[phase portion ph4 of calculating channel ch3]

| circuit | output signal ts6 | ts7 |
|---|---|---|
| shift register 91 | 16wt | 8wt |
| selector 93 | wt | 8wt |
| shifter 94 | 4wt | 32wt |
| shifter 95 | wt | 8wt |
| shifter 96 | 2wt | 32wt |
| gate circuit 97 | 0 | 40wt |
| addition-subtraction circuit 98 | 2wt | 40wt |
| data converter 99 | 2wt | 40wt |
| sine function memory | log (sin 2wt) | log (sin 40wt) |
| envelope generator 11 | log EV40 | log EV40 |
| doubler 120 | 2log (sin 2wt) | — |
| adder 123 | log EV40 + 2log (sin 2wt) | log EV40 + 2log (sin 2wt) + log (sin 40wt) |
| register 124 | log EV40 + 2log (sin 2wt) | log EV40 + 2log (sin 2wt) + log (sin 40wt) |
| LOG-LIN converter 125 | | (EV40) × ($\sin^2$ 2wt) × (sin 40wt) |

Figure 6:
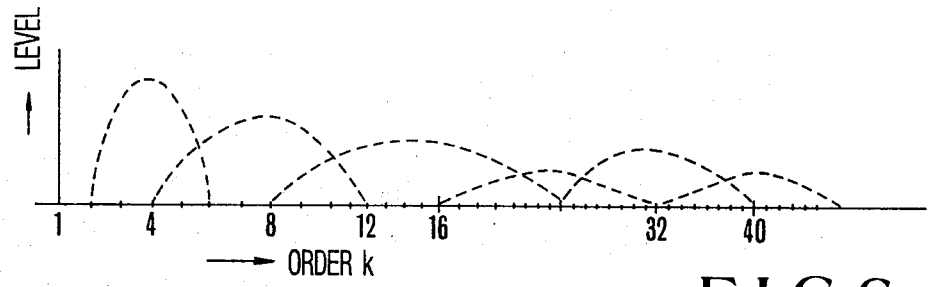
FIG. 6 is a spectrum diagram of the partial tone components calculated by using the time window signals and the frequency signals shown in FIG. 5.

The partial tone components h1, h4w, h8w, h16w, h24w, h32w and h40w calculated in a manner described above are synthesized in the synthesizing circuit 13 at each DAC cycle, and the synthesized value is converted into an analogue musical tone signal instantaneous value Mw (t) in the digital-analogue converter 14 and then supplied to the sound system 15, whereby it produces a tone signal imparted with a spectrum envelope as shown in FIG. 6.

As above described in the electronic musical instrument of this embodiment, since a single sine function memory device is used on the time division basis to generate time window signals and partial tone signals it is possible to calculate partial tone components hkw distributed over a wide frequency bandwidth with extremely simple construction. Moreover, since the amplitude modulation is effected by a logarithmic addition operation for calculating such partial tone components as hkw it is possible to shorten the calculation time. Moreover since the time window signal W is formed by doubling the sine wave signal amplitude value, it is possible to greatly simplify the circuit necessary to calculate the window signal. The detail of the timing pulse generator 7 and the envelope generator 11 will now be described.

Figure 8:
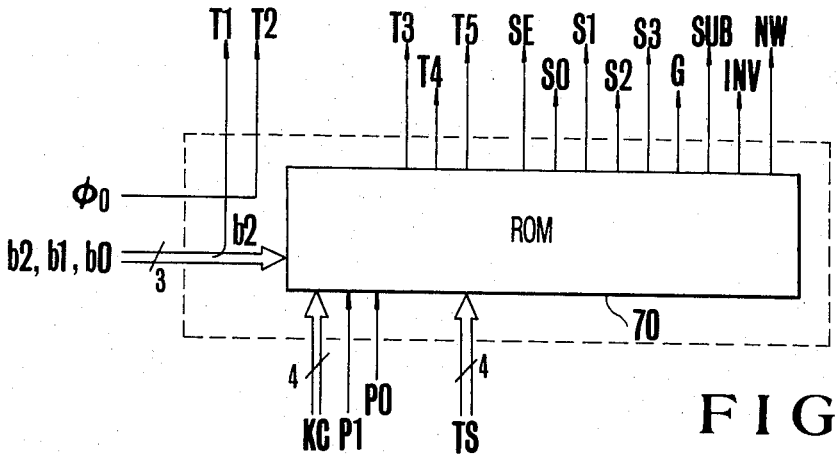
FIGS. 8 through 10 show the detail of the timing pulse generator shown in FIG. 1; and its operation.

The timing pulse generator 7 is constituted by a read only memory device (ROM) 70, for example, as shown in FIG. 8. The ROM 70 has a plurality of memory blocks MB designated by a tone color setting signal TS and a key code KC. Respective memory blocks MB store timing pulses T3 through T5, SE, S0 through S3, G, SUB, INV and NW for generating predetermined time window signals W or the frequency signals Hk in respective time slots ts0 through ts7 designated by signals b2, b1 and b0 and signals P1 and P0 corresponding to the set tone color and the tone range of a depressed key.

Consequently, where a tone color setting signal TS, a key code KC, signals b2, b1 and b0 and signals P1 and P0 are applied as address signals, timing pulses T3 through T5, . . . NW corresponding to the set tone color and the tone range of the depressed key (identified by the key code KC) are produced in synchronism with the partial tone calculating timings of respective calculating channels ch0 through ch3. As can be noted from FIG. 2, although the timing pulses T1 and T2 are the same as signals b2 and $\phi$0, they are designated by different signal names.

When the upper order four bits of the key code KC is inputted to the ROM 70 and where the tone color setting signal TS comprises 4 bits, since the types of the timing pulses are 10 (10 bits), the ROM 70 is required to have memory capacity of $(2^{13})\times(10)=80K$ bits, thus considerably increasing the memory capacity.

Figure 9:
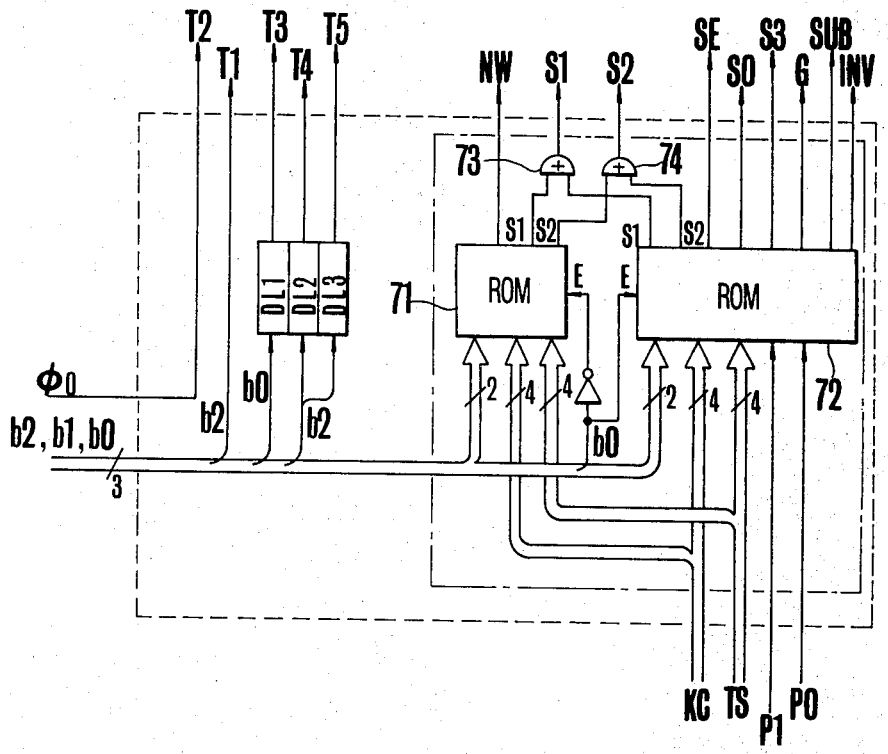

As can be noted from FIG. 2, the timing pulses T3, T4 and T5 may be formed by slightly delaying signals b0 and b2, so that as shown in FIG. 9, signal b0 is delayed with the delay circuit DL1 to form the timing pulse T3, while the signal b2 is delayed by the delay circuit DL2 to form the timing pulse T4 and the signal b2 is delayed by the delay circuit DL3 to form the timing pulse T5. Denoting the delay times of delay circuits DL1 through DL3 by $\tau 1$, $\tau 2$ and $\tau 3$ respectively, the delay times are set to satisfy a relation $\tau 1<\tau 3<\tau 2$.

Regarding other timing pulses, they are divided into a first group consisting of the timing pulses NW, S1 and S2 necessary to generate time window signals W, and a second group consisting of timing pulses S0, S1, S2, S3, SE, G, SUB and INV necessary to generate frequency signals Hk. The circuit is constructed such that the timing pulses belonging to the first group is outputted from the first ROM 71 enabled when the signal b0 is "0", whereas the timing pulses belonging to the second group are generated from the second ROM 72 enabled when the signal b0 is "1". Since timing pulses S1 and S2 belong to both first and second groups they are outputted via OR gate circuits 73 and 74.

With this construction, since the address signal has a total of 10 bits, and the output signal has 3 bits, the memory capacity of the first ROM 71 is $(2^{10})\times(3)$ bits. Furthermore, since the address signal has a total of 12 bits and the output signal has 8 bits the memory capacity of the second ROM 72 is $(2^{12})\times(8)$ bits so that the total memory capacity of the first and second ROMs 71 and 72 is $$(2^{10})\times(3)+(2^{12})\times(8)=35{,}840 \text{ bits}$$

It should be noted that this memory capacity is about $\frac{1}{2}$ of that shown in FIG. 8.

Figure 10:
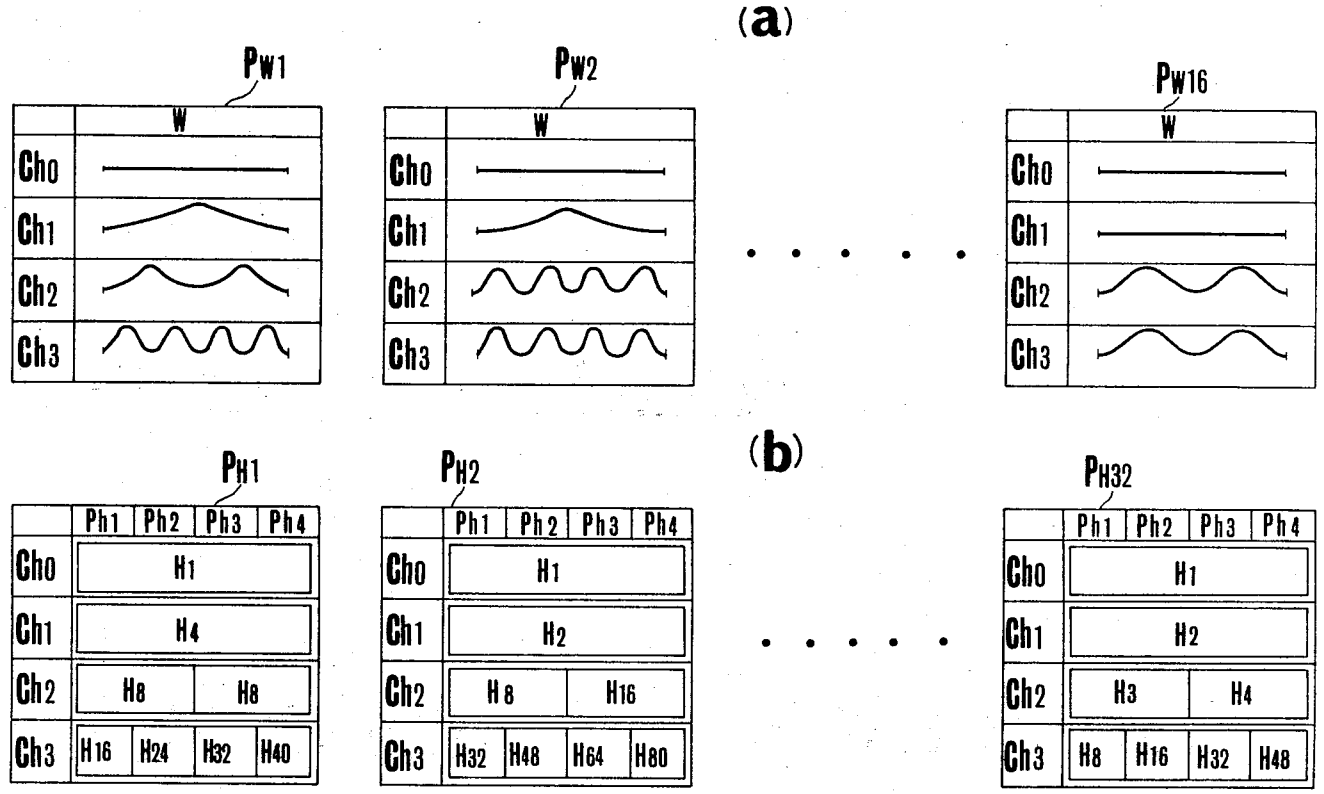
Figure 10:
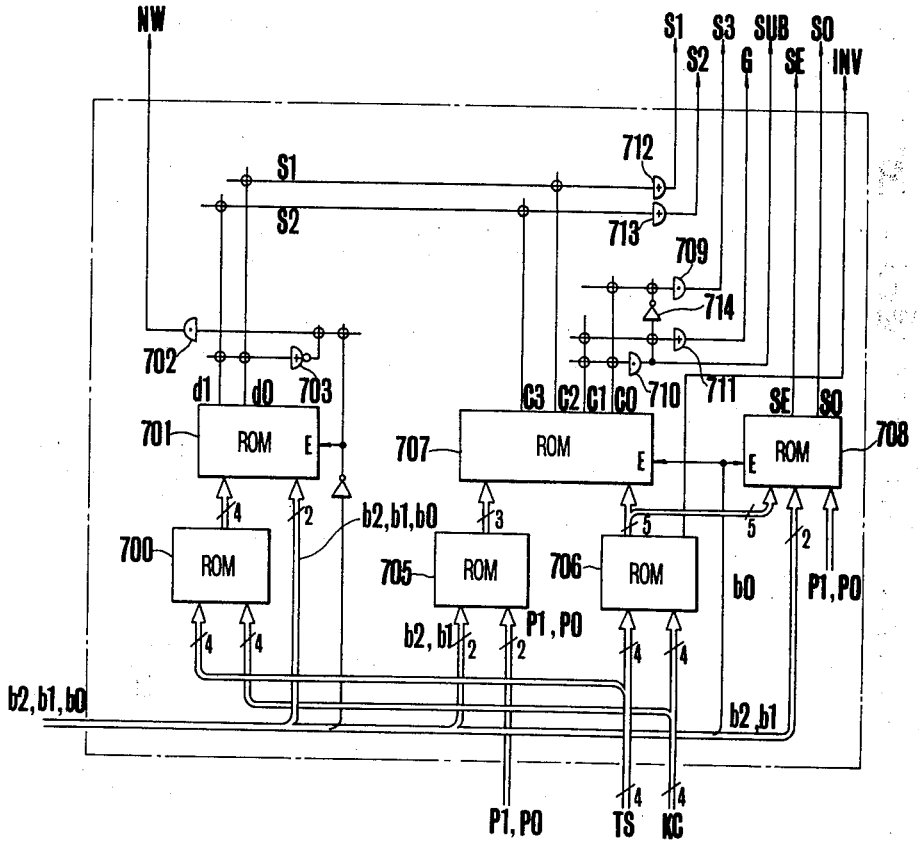

The memory capacity can be further reduced where the types of the time window patterns Pw produced in the calculating channels ch0 through ch3 is limited to 16 as shown by FIG. 10*a* for a tone color designatable by a combination of a key code KC and a tone color setting information TS and by setting the frequency signals Hk produced in respective calculating channels ch0 through ch3 to be 8 frequencies designatable by a combination of the key code KC and the tone color setting information TS so as to cause combinations of these 8 frequencies to form 32 tone color components of patterns PH1 through PH32 as shown in FIG. 10*b*.

The circuit shown in FIG. 10*c* is designed on the preset conditions described above and corresponds to a circuit portion including the first and second ROMs 71 and 72 and the OR gate circuits 73 and 74 shown in FIG. 9. In FIG. 10*c* a first ROM 700 produces a 4 bit signal that designates one of the time window pattern designated by the combination of the key code KC and the tone color setting signal TS among 16 types of the time window patterns $P_{w1}$ through $P_{w16}$. This 4 bit signal outputted from the first ROM 700 is applied to the second ROM 701 together with the signals b2 and b1 that designate the calculating channels as an address signal.

The second ROM 701 stores in its addresses 2 bit signals d1 and d0 adapted to form timing pulses NW, S1 and S2 utilized to designate the type of the time window signals W as shown in FIG. 4, and is enabled only when signal b0 is "0". More particularly, the second ROM 701 produces two bits signals d1 and d0 adapted to form a time window pattern (one of $P_{w1}$ through $P_{w16}$) designated by a set tone color (based on the key code KC and the tone color setting signal TS) for each of the calculating channels ch0 through ch3. These two bits signals d1 and d0 are decoded by an AND gate circuit 702 and an NOR gate circuit 703 to be outputted as timing pulses S1, S2 and NW.

A third ROM 705 produces a 3 bit signal that designates a frequency signal Hk to be produced in respective calculatinhg channels in respective phase portions ph1 through ph4 for each one of calculating channels ch0 through ch3, among frequency signals of 8 frequencies to be calculated in the calculating channels ch0 through ch3.

A fifth ROM 706 produces a 5 bit signal adapted to designate either one the generating patterns PH1 through PH32 of the frequency signal Hk corresponding to a set color based on the key code KC and the tone color designation signal TC, as well as a timing pulse INV for erasing even number ordered components of the musical tone signal.

The output signals outputted from the third and fifth ROMs 705 and 706 are applied to the fourth ROM 707 as address signals. However, the timing signal INV is supplied to the outside as it is. The five bit signal outputted from the fifth ROM 706 is supplied to a sixth ROM 708 as an address signal together with signals b2, b1, P1 and P0.

The fourth ROM 707 produces signals C3, C2, C1 and C0 for forming a frequency signal Hk designated by a 3 bit signal given from the third ROM 705 among frequency signals Hk of 8 frequencies of the generating pattern (one of PH1 through PH32) of the frequency signal Hk designated by the 5 bit signal supplied from the fifth ROM 706. The sixth ROM 708 produces timing pulses SE and S0 adapted to form frequency signals of 8 frequencies among generating patterns (one of (PH1 through PH32) of the frequency signal Hk designated by the 5 bit signal given from the fifth ROM 706.

4 bit output signals C3 through C0 of the fourth ROM 707 are used to prepare timing pulses S1, S2, S3, G, SUB and these one bit signals are decoded as shown in the following Table XVIII in a circuit comprising AND gate circuits 709 and 710, OR gate circuits 711 through 713 and an inverter 714 and are outputted as the timing pulses which function in the same manner as the signals S1 through SUB shown in Table VII.

TABLE XVIII

| output of fourth ROM 707 | | | | |
|---|---|---|---|---|
| C3 | C2 | C1 | C0 | ax |
| 0 | 0 | 0 | 0 | x |
| 0 | 1 | 0 | 0 | 2x |
| 0 | 1 | 1 | 0 | 3x |
| 1 | 0 | 0 | 0 | 4x |
| 1 | 0 | 1 | 0 | 5x |
| 1 | 0 | 1 | 1 | 6x |
| 1 | 1 | 0 | 1 | 7x |
| 1 | 1 | 0 | 0 | 8x |
| 1 | 1 | 1 | 0 | 9x |
| 1 | 1 | 1 | 1 | 10x |

With the construction described above, the memory capacities of the first to sixth ROMs 700 through 708 become to those shown in the following Table XIX showing decrease of the memory capacities than in the case shown in FIG. 9.

TABLE XIX

| | address signal | output signal | memory capacity (bits) |
|---|---|---|---|
| first ROM | 8 bits | 4 bits | $2^8 \times 4 = 1024$ |
| second ROM | 6 bits | 2 bits | $2^6 \times 2 = 128$ |
| third ROM | 4 bits | 3 bits | $2^4 \times 3 = 48$ |
| fourth ROM | 8 bits | 4 bits | $2^8 \times 4 = 1024$ |
| fifth ROM | 8 bits | 6 bits | $2^8 \times 6 = 1536$ |
| sixth ROM | 9 bits | 2 bits | $2^9 \times 2 = 1024$ |

Figure 11:
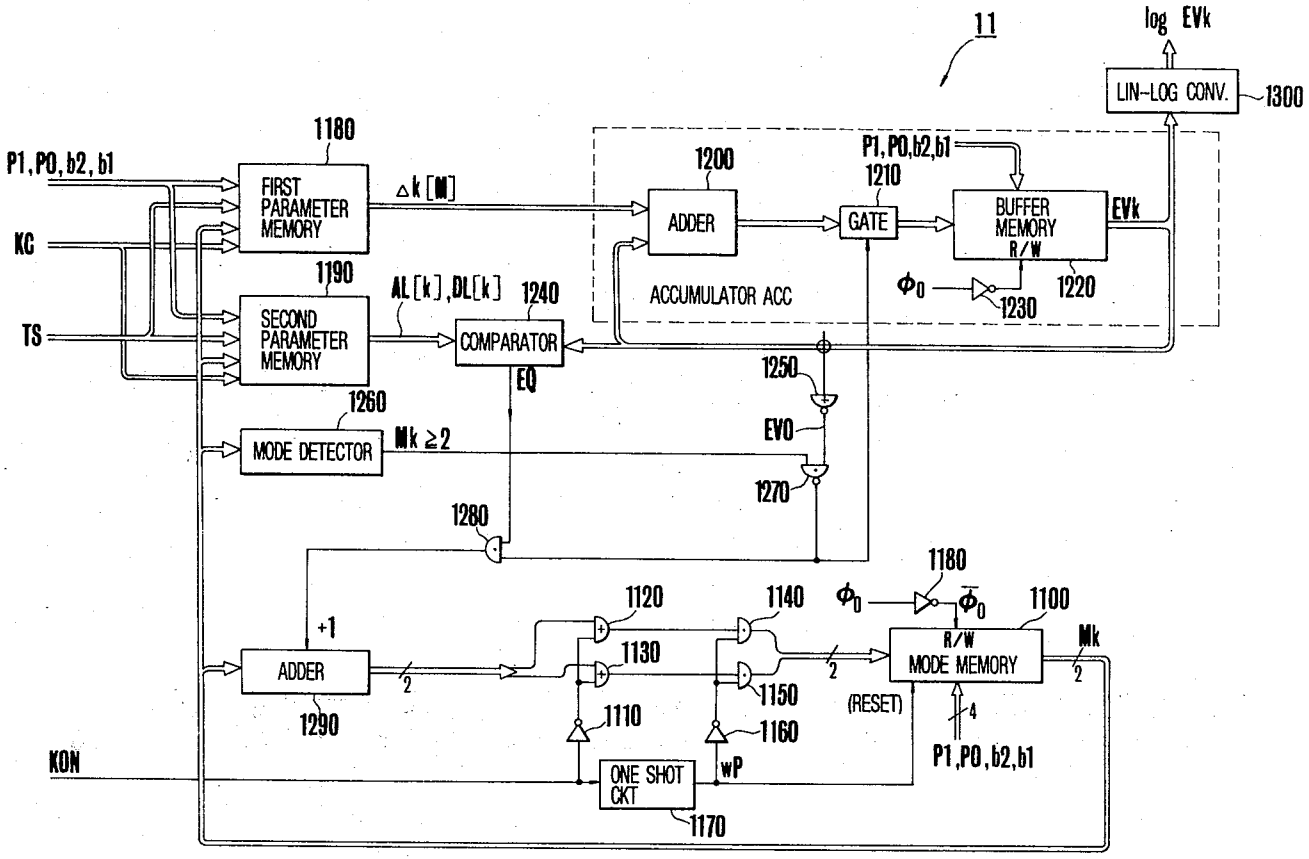
FIG. 11 is a block diagram showing the detail of an envelope generator shown in FIG. 1.

The detail of the circuit construction of the envelope generator 11 shown in FIG. 11 which forms envelope signals EVk (EV1 through EV40) for respective frequency signals (H1 through H40 shown in FIG. 5) and outputs the signals EVk thus formed in synchronism with the calculating timings of respective partial tone signals. Each one of the envelope signals EVk comprises 4 envelope segments of an attack, a first decay, a sustain, and a second delay. Such envelope signal EVk is formed by sequentially accumulating, at a predetermined speed, the information Δk[M] representing the increments (at the time of attack) in each segment of the signal EVk applied for each frequency signal or decrements (at the time of the first decay, the sustain and the second decay), where M represents the types of the segments. In this embodiment attack is represented by "0", the first decay "1", the sustain by "2", and the second decay by "3". However, the waveforms of respective signals are different depending upon the tone colors and correspond to tone colors set by the tone color setter 8. For this reason the information Δk[M] and a decay level information DL[k] are determined for respective frequency signals corresponding to set tone colors.

For example, the sequential accumulation of the increment information Δk[0] is continued until the accumulated value Δk[0] of the increment information Δk[0] comes to coincide with the attack level information AL[k] of the signal EVk given at each frequency signal corresponding to the set tone color.

The sequential accumulation of the decrement information Δk[1] of M=1 in a segment of the first decay is continued until the difference "AL[k]−ΣΔk[1]" between the attack level information AL[k] and the accumulated value ΣΔk[1] of Δk[1] coincides with the decay level information DL[k] of the signal EVk. Further the sequential accumulation of the decrement information Δk[2], in which M=2, of a sustain segment is continued until the key-on signal KON builds down. The sequential accumulation of the decrement information kΔ[3], in which M=3, in a segment of the second decay is continued until the difference "SL[k]−ΣΔk[3]" between the sustain level SL[k] at a key-off point and the accumulated value ΣΔk[3] of Δk[3] becomes "0".

In FIG. 11, first and second parameter memory devices 1180, 1190 are provided with addresses designated by slot number signals b2 through b1, phase designation signals P2 and P1, a tone color designation signal TS and a segment information Mk representing a segment presently calculated. Respective memory addresses store increment informations Δk[M] regarding respective frequency signals corresponding to set colors, attack level informations AL[k], and decay level informations DL[k].

A mode memory device 1100 has memory addresses designated by the slot number signals b2 and b1 and the phase designation signals P2 and P1, and storing segment informations Mk representing segments being calculated of the signals EVk regarding respective frequency signals. At the time of key-off all segment informations of the signals EVk regarding respective frequency signals are "3". Because the key-on signal KON becomes "0" when a depressed key is released whereby the output of an inverter 1110 becomes "1" with the results that both outputs of OR gate circuits 1120 and 1130 become "1" and this signal "11" ("3" according to the decimal representation) is applied to the mode memory device 1100 as a segment information of Mk=3 to be written therein according to a clock signal $\phi$o. given by an inverter 1180.

Under these state, when the key-on signal KON becomes "1" due to a key depression, a narrow width one shot pulse WP would be outputted from an one shot circuit 1170 in synchronism with the building up of the key-on signal KON as shown in FIG. 12*c*. This one shot pulse WP is inverted by an inverter 1160 and then supplied to AND gate circuits 1140 and 1150 as an inhibition signal and to the mode memory device 1100 as a reset signal for resetting all stored informations. Accordingly, segment informations of Mk=3 stored in all addresses of the mode memory device 1100 are reset to become Mk=0.

When the segment informations Mk outputted from the mode memory device 1100 becomes "0", the first and second parameter memory devices 1180 and 1190 produce increment informations k[0] and attack informations AL[k] regarding attacks for respective frequency signals corresponding to the tone color setting information TS in synchronism with the calculating time slots of the frequency signals. The increment information Δk[0] regarding the attack for each frequency signal is sequentially accumulated in an accumulator ACC comprising an adder 1200, a gate circuit 1210, a buffer memory device 1220 and an inverter 1230 in each DAC cycle (see FIG. 2).

Figure 12:
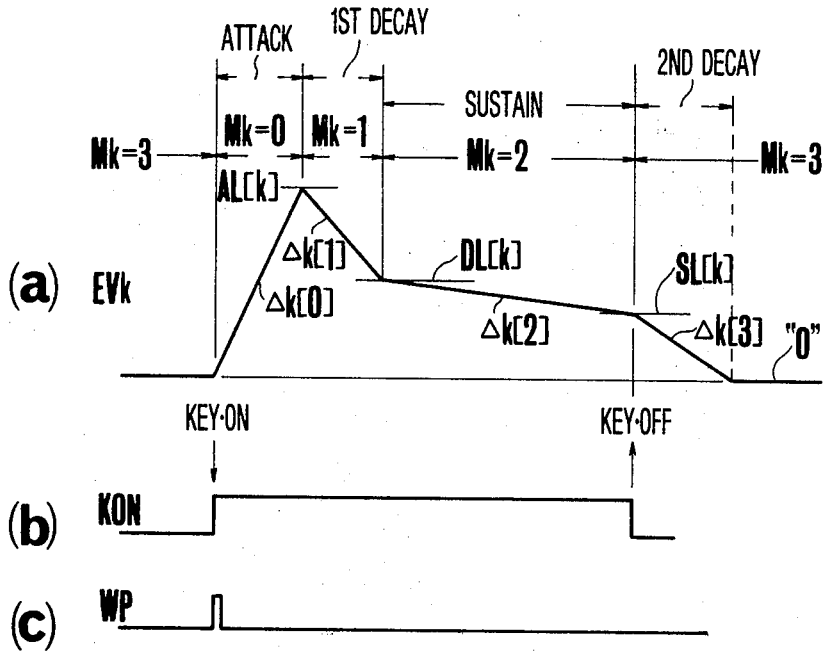
FIG. 12 shows one example of an envelope signal waveform.

More particularly, the buffer memory device 1220 has memory addresses corresponding to the types of the frequency signals H1 through H40. These addresses store the successively accumulated values ΣΔk[M] of respective of DAC cycle of the information Δk[M] and output these sequentially accumulated values ΣΔk[M] as the present amplitude values of the envelope signal EVk. When an increment signal Δk[0] of each frequency signal regarding the attack is applied to one input of the adder 1200, the increment signal Δk[0] is added to the accumulated value ΣΔk[0] of a corresponding frequency signal read out from the buffer memory device 1220 to form a new accumulated value "ΣΔk[0]+Δk[0]" which is written into the buffer memory device 1220 through the gate circuit 1210. In this case the accumulated values ΣΔk[0] regarding the attacks of the frequency signals outputted from the buffer memory device 1220 are all zero in the early stage. Accordingly, subsequent to the generation of a key-on signal due to a key-depression, the accumulated values ΣΔk[0] regarding the attacks of respective frequency signals gradually increases from zero as shown in FIG. 12, and the rate of increase increases with the value of the increment information ΔK[0].

As above described the envelope signals EVk regarding attack segments are independently formed for respective frequency signals and the accumulated values ΣΔk[0] of respective frequency signals are constantly compared with the attack level informations AL[k] for respective frequencies with a comparator 1240. When the result of comparison shows that ΣΔk[0]=AL[k], the comparator 1240 produces a coincidence signal EQ showing that the accumulated value ΣΔk[0] of a given frequency signal has reached an attack level. This coincidence signal EQ is supplied to one input of an AND gate circuit 1280 with the other input supplied with a signal "1" because the segment information Mk does not satisfy a relation Mk≧2 (since the output of the mode detector 1260 is "0", the output of the NAND gate circuit 1270 is "1"). Consequently, the coincidence signal EQ is applied to the "+1" input of an adder 1290 via the AND gate circuit 1280 with the result that the adder 1290 adds "+1" to the segment information Mk=0 regarding a frequency signal in which "ΣΔk[0]=AL[k]". The result of the addition operation is applied to the mode memory device 1100 via OR gate circuits 1120, 1130 and AND gate circuits 1140 and 1150 so that the segment information Mk in the mode memory device 1100 regarding the frequency signal which has changed to "ΣΔk[0]=AL[k]" would be updated to Mk=1. Thereafter, the accumulation operation is executed base on the decrement information Δk[1] regarding the decay of the first decay.

More particularly, when the segment information Mk outputted from the mode memory device 1100 is updated from Mk=0 to Mk=1, the first and second parameter memory devices 1180 and 1190 would output a decrement information Δk[1] (a negative value) regarding the segment of the first decay and a decay level information DL[k] respectively. Then the accumulator ACC made up of the adder 1200, the gate circuit 1210, the buffer memory device 1220 and the inverter 1230 sequentially adds the negative decrement information Δk[1] to the accumulated value ΣΔk[0] (=AL[k]) which is obtained when the attack level is reached in each DAC cycle with the result that the accumulated value ΣΔk[1] at the segment of the first decay decreases gradually, such gradually decreasing accumulated value ΣΔk[1] being normally compared with a decay level information DL[k] in the comparator 1240. When the result of comparison becomes "ΣΔk[1]=DL[k]" a coincidence signal EQ is produced from the comparator 1240. At this time, since the segment information Mk does not satisfy a relation Mk≧2, the coincidence signal EQ outputted from the comparator 1240 is applied to "+1" input of the adder 1290 through AND gate circuit 1280, whereby the adder 1290 adds "+1" to the segment information Mk=1 regarding the frequency signal which become "ΣΔk[1]=DL[k". The result of addition is applied to the mode memory device 1100 via OR gate circuits 1120, 1130 and AND gate circuits 1140, 1150 as an information write signal. Thus the segment information Mk in the mode memory device 1100 regarding a frequency signal which became "ΣΔk[1]=DL[k]" would be updated to Mk=2. Thereafter, the accumulation operation is executed based on a decrement information Δk[2] regarding the segment of the sustain.

More particularly, when the segment information Mk outputted from the mode memory device 1100 is updated to Mk=2 from Mk=1, the first parameter memory device 1180 would produce a decrement informations (a negative value) regarding the segment of the sustain. Then, in the accumulator ACC, the negative decrement information Δk[2] is sequentially added to the accumulated value ΣΔk[1] obtainable when a first decay level DL[k] is reached in each DAC cycle, whereby the accumulated value ΣΔk[2] in the sustain segment decreases successively. During such accumulation operation, when the key-on signal becomes "0" as a result of key release, the inverter 1110 applies a signal "1" to the OR gate circuits 1120 and 1130. Then the signals "1" outputted therefrom are inputted to the mode memory device 1100 via AND gate circuits 1140 and 1150 as the information write signal. Accordingly, the segment information Mk is updated to Mk=3 from Mk=2. Thereafter, the accumulation operation proceeds based on the decrement information Δk[3] regarding the second decay segment.

Although the accumulation operation regarding the second decay information is executed in the same manner as above described it is completed when the accumulated value ΣΔk[3] becomes zero.

More particularly, when the accumulated value ΣΔk[3] becomes zero a detection signal EVO indicating this fact is outputted from the NOR gate circuit 1250. At this time, since the segment information becomes Mk=3, a mode detector 1260 produces a signal "1" showing that Mk≧2Accordingly, the output signal of the NAND gate circuit 1270 becomes "0" to disable the AND gate circuit 1210 of the accumulator ACC. Consequently, the accumulation operation regarding the frequency signal which became ΣΔk[3]=0 is stopped.

Where the decrement information Δk[2] regarding a sustain segment has a large value the accumulated value $\Sigma\Delta k[2]$ may became zero before the key-on signal KON becomes "0". Even in such a case, a signal "0" is applied to the gate circuit 1210 from the NAND gate circuit 1270 thus stopping the accumulation operation. In this case, the segment information is updated to $Mk=3$ when the key-on signal KON becomes "0".

The accumulated values $\Sigma\Delta k[0]$, $\Sigma\Delta k[1]$, $\Sigma\Delta k[2]$, and $\Sigma\Delta k[3]$ respectively regarding the segments of the attack, first decay, sustain, and the second decay for each frequency signal which are formed as above described are converted into logarithmic values by a logarithm converter 1300 and then outputted as envelope signals log EVk in synchronism with the calculating timings of respective frequency signals thereby setting different amplitudes of the envelope waveforms for respective frequency signals.

Although in the foregoing embodiment, the frequency signal and the time window signal were generated from a memory device storing a sine waveform, they can be generated from a memory device storing a cosine waveform. Of course, instead of generating sampling point amplitude values of a sine or cosine waveform from a memory device such amplitude values can be formed by arithmetic processings.

Further, it should be understood that the number of the calculating channels is not limited to 4 as shown in the embodiment and that the calculating channels may be of the parallel converted type instead of the time divisioned type.

What is claimed is:

1. An electronic musical instrument comprising:

phase designation signal generating means for generating first and second phase designation signals on a time division basis, said first and second phase designation signals representing one phase angle value and another phase angle value respectively;

memory means connected to said phase designation signal generating means for storing one predetermined waveshape and for delivering a tone signal in response to said first phase designation signal and delivering a window signal in response to said second phase designation signal on a time division basis, both the form of said tone signal and the form of said window signal being the same as that of said predetermined waveshape;

modulation means for amplitude-modulating said tone signal in accordance with a modulation signal corresponding to said window signal and for outputting the modulated tone signal; and tone production means for producing a musical tone in response to said modulated tone signal.

2. An electronic musical instrument according to claim 1 which further comprises:

generating means inserted between said memory means and said modulation means for generating said modulation signal in response to said window signal.

3. An electronic musical instrument according to claim 1 which further comprises keyboard means having a plurality of keys and circuit means for producing a key signal corresponding to a depressed key of said keyboard and supplying said key signal to said phase designation signal generating means, the frequency of said tone signal and the time width of said window signal being established in response to said key signal.

4. An electronic musical instrument according to claim 2 wherein said predetermined waveshape is a sinusoidal waveform and said modulation means comprises means for squaring an amplitude value of said window signal and forming a time window signal and multiplying means for multiplying said tone signal with said time window signal, said modulated tone signal being outputted from said multiplying means.

5. An electronic musical instrument according to claim 1 wherein said phase designation signal generating means causes said second phase designation signal to have a period which is twice the time width of the time window signal to be formed.

6. An electronic musical instrument according to claim 1 which further comprises tone color setting means for selecting tone color of said musical tone among predetermined kinds of tone colors and supplies a tone color signal corresponding to said selected tone color to said phase designation signal generating means, the frequency of said tone signal and the time width of said window signal being established in response to said color signal.

7. An electronic musical instrument comprising a plurality of musical tone forming channels each of which comprises:

phase designation generating means for generating first and second phase designation signals on a time division basis;

a memory storing a waveform, function generating means connected to said phase designation generating means for generating, by time shared readout of the same waveform from said memory, a frequency signal having a frequency in response to said first signal and a window signal having a time width in response to said second signal, the shape of both said frequency signal and said window signal being established by the shape of said same read out waveform;

modulating means for amplifude-modulating said frequency signal in accordance with said window signal and producing a modulated signal; and means for forming a musical tone corresponding to said modulated signal.

8. An electronic musical instrument according to claim 7 wherein said plurality of partial tone forming channels form independent partial tone components of a musical tone in a plurality of time divisioned time slots.

9. In an electronic musical instrument in which a musical tone is synthesized by calculating successive sample point amplitudes, each such amplitude being the sum of contributions of plural partial tone components, each being evaluated by scaling a frequency signal by a window function, the improvement comprising:

a waveform memory storing sampled amplitude values of a waveshape, first means for accessing said waveshape from said memory at a first rate, said waveshape accessed by said first means establishing said frequency signal, and second means, operative in time shared relationship with said first means, for accessing said waveshape from said memory at a second rate different from said first rate, said waveshape accessed by said second means establishing said window function, whereby the shapes of said frequency signal and said window signal both are established by the same waveshape stored in a single memory.

10. An electronic musical instrument according to claim 9 wherein said waveform memory stores a sinusoidal waveshape, wherein said frequency signal consists of the sinusoidal waveshape read out by said first means, and wherein said window function has a sine squared shape formed by effectively squaring the read out values of said waveshape.

11. An electronic musical instrument according to claim 10 wherein said sinusoidal waveshape is stored as logarithmic values in said waveform memory, and further comprising means for doubling the waveshape values read out by said second means to form said sine squared window function.

* * * * *